US006326112B1

(12) United States Patent
Tamura et al.

(10) Patent No.: US 6,326,112 B1
(45) Date of Patent: Dec. 4, 2001

(54) ELECTROPHOTOGRAPHIC PHOTORECEPTOR, AND PROCESS CARTRIDGE AND IMAGE FORMING APPARATUS USING THE PHOTORECEPTOR

(75) Inventors: Hiroshi Tamura; Hidetoshi Kami; Katsuichi Ohta; Tetsuro Suzuki; Tatsuya Niimi; Narihito Kojima, all of Shizuoka-ken (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 09/642,117

(22) Filed: Aug. 21, 2000

(30) Foreign Application Priority Data

Aug. 20, 1999 (JP) ..... 11-233969

(51) Int. Cl.[7] ..... G03G 5/047
(52) U.S. Cl. ..... 430/58.7; 430/126; 399/159
(58) Field of Search ..... 430/58.35, 58.45, 430/96, 58.7, 126; 399/159

(56) References Cited

U.S. PATENT DOCUMENTS 5,164,276 * 11/1992 Robinson et al. ..... 430/58.35
6,187,492 * 2/2001 Ri et al. ..... 430/96

FOREIGN PATENT DOCUMENTS

| | | |
|---|---|---|
| 59-223442 | 12/1984 | (JP) . |
| 63-305364 | 12/1988 | (JP) . |
| 1-205171 | 8/1989 | (JP) . |
| 7-333881 | 12/1995 | (JP) . |
| 8-15887 | 1/1996 | (JP) . |
| 8-101524 | 4/1996 | (JP) . |
| 8-123053 | 5/1996 | (JP) . |
| 8-146641 | 6/1996 | (JP) . |
| 8-179542 | 7/1996 | (JP) . |

* cited by examiner

*Primary Examiner*—John Goodrow
(74) *Attorney, Agent, or Firm*—Oblon, Spivak, McClelland, Maier & Neustadt, P.C.

(57) ABSTRACT

An electrophotographic photoreceptor which includes an electroconductive substrate, and a photosensitive layer which is formed overlying the substrate, wherein the photosensitive layer includes a charge generation material, a charge transport polymer material including triarylamine structure and a soft segment in a main chain thereof, and a filler.

18 Claims, 4 Drawing Sheets

ELECTROPHOTOGRAPHIC PHOTORECEPTOR, AND PROCESS CARTRIDGE AND IMAGE FORMING APPARATUS USING THE PHOTORECEPTOR

BACKGROUND OF THE INVENTION

1. Field of the Invention

The present invention relates to an electrophotographic photoreceptor useful for electrophotographic image forming apparatus such as copiers, facsimiles, printers and direct digital printing plate forming machines, and to a process cartridge and image forming apparatus using the photoreceptor. More particularly, the present invention relates to an electrophotographic photoreceptor including a charge transport polymer material and a filler, and to a process cartridge and image forming apparatus using the photoreceptor.

2. Discussion of the Background

As electrophotographic photoreceptors, the following photoreceptors are well known:

(1) photoreceptors in which a photosensitive layer including selenium or a selenium alloy as a main component is formed on an electroconductive substrate;

(2) photoreceptors in which a photosensitive layer including an inorganic photosensitive material such as zinc oxide or cadmium sulfide and a binder resin is formed on an electroconductive substrate;

(3) photoreceptors in which a photosensitive layer including an amorphous silicon compound is formed on an electroconductive substrate; and (4) photoreceptors in which a photosensitive layer including an organic photosensitive material is formed on an electroconductive substrate (hereinafter referred to as an organic photoreceptor or an OPC).

Among these photoreceptors, organic photoreceptors are widely used because of having advantages against other photoreceptors such that they have relatively low manufacturing costs and they are friendly to environment, and in addition there is a wide choice when a desired OPC is designed.

On the other hand, recently the development of information processing technology is remarkable. Electrophotographic image forming apparatus such as electrophotographic copiers and printers become more important as an information processing apparatus. In addition, needs for high speed image forming apparatus, miniaturized image forming apparatus, and high quality image forming apparatus increase more and more. Therefore, a need exists for an electrophotographic photoreceptor (hereinafter referred to as a photoreceptor) having good durability.

In electrophotographic image forming apparatus, processes such as charging, exposure, development, image transfer and cleaning are repeatedly performed. A photoreceptor used in such an electrophotographic image forming apparatus is subjected to various mechanical and chemical actions, and thereby the mechanical and electrostatic characteristics of the photoreceptor deteriorate. For example, abrasion and scratch are exemplified as the mechanical damages. In addition, as the electrostatic damages, the following damages are exemplified:

(1) the maximum charge quantity decreases;

(2) the dark decay increases; and (3) the photosensitivity deteriorates.

Such electrostatic damages are caused by oxidization of the photoreceptor constituents such as a binder resin, a charge transport material etc. due to ozone and NOx which are generated in the charging process.

In addition, when products, which are generated due to corona discharging performed in the charging process, adhere to a photoreceptor, the image qualities of images produced by the photoreceptor deteriorate.

As the size of image forming apparatus becomes small, the diameter of the photoreceptor drum used for the image forming apparatus also becomes small. When a small-sized photoreceptor is used, there are great risks such that the photoreceptor is easily abraded. This is because it is needed to use a relatively hard rubber blade for cleaning the surface of such a small-sized photoreceptor while applying relatively high pressure to the rubber blade. Therefore, the abrasion of the photoreceptor is accelerated, and thereby charge properties of the photoreceptor such as maximum charge quantity and photosensitivity change, resulting in formation of undesired images and deterioration of color reproducibility of the resultant color images.

In attempting to solve these problems, Japanese Laid-Open Patent Publications Nos. 1-205171, 7-333881, 8-15887, 8-123053, 8-146641 etc. have disclosed techniques in which a filler is included in a photoreceptor to reduce abrasion of the photoreceptor. However, when these photoreceptors are repeatedly used for a long time, the potential of an area of the photoreceptor, which is exposed to imagewise light, increases, resulting in deterioration of image qualities, such as decrease of image density. In addition, Japanese Laid-Open Patent Publication No. 8-179542 discloses a technique in which a protective layer is formed on the photoreceptor. However, when a protective layer is formed, resolution of the resultant images deteriorates, and therefore this technique is not satisfactory.

Japanese Laid-Open Patent Publication No. 59-223442 discloses a photoreceptor including a protective layer having two layers in which the concentration of a filler in the upper protective layer is relatively high compared to that in the lower protective layer, wherein the filler is electroconductive However, when an electroconductive filler is used in a protective layer of a photoreceptor, the charge formed on the photoreceptor diffuses if the photoreceptor is exposed to dot-shaped imagewise light, resulting in deterioration of image reproducibility. In particular, this phenomenon prominently occurs when such a filler is used for organic photoreceptors.

In addition, Japanese Laid-Open Patent Publication No. 63-305364 discloses a photoreceptor including a protective layer having two layers in which the concentration of a filler in the upper protective layer is relatively high compared to that in the lower protective layer, wherein the protective layers include a combination of an insulating silicon dioxide and a nylon/urethane resin. This protective layer has significant dependence on environmental conditions. Therefore, the photoreceptor has relatively low reliability.

Further, Japanese Laid-Open Patent Publication No. 8-101524 and U.S. Pat. No. 5,677,094 have disclosed a photoreceptor in which a charge transport polymer material including a structure in its polymer chain, which has a charge transport function, is used in a protective layer. In addition, a photoreceptor having a protective layer including a charge transport polymer material and a filler having high hardness is also disclosed therein. When the photoreceptor having a protective layer including a charge transport polymer material and a filler having high hardness is used, it is possible to control increase of residual potential and abrasion of the resultant photoreceptor so as to be relatively low compared to the former photoreceptors.

However, the photoreceptor has a drawback in that undesired images due to local charge leak of the photoreceptor when the photoreceptor is repeatedly used. For example, when a charged photoreceptor is developed with a toner having a charge whose polarity is the same as the charge formed on the photoreceptor (i.e., when a reverse development is performed), undesired black spots are produced in a background area of images. When a charged photoreceptor is developed with a toner having a charge whose polarity is opposite to the charge formed on the photoreceptor (i.e., when a normal development is performed), undesired white spots are produced in images.

In addition, such a photoreceptor having a protective layer including a conventional charge transport polymer material and a filler has a drawback in that when the photoreceptor is preserved in high temperature/humidity conditions or when the surface of the photoreceptor contacts paper, rubber, hands, fingers etc., cracks are generated in the surface portion of or inside of the photosensitive layer, resulting in production of undesired images (black streak or white streak images) corresponding to the cracks, or peeling of the photosensitive layer. In particular, when a belt-shaped photoreceptor having such a photosensitive layer is fed by a plurality of drive/support roller each having a small diameter, cracks are easily formed therein because the belt-shaped photoreceptor is bent in a small radius of curvature at the drive/support rollers. Therefore, the photoreceptor has a short life.

Because of these reasons, a need exists for an electrophotographic photoreceptor which has high sensitivity and long life, and can produce good images without image defects such as black or white spots and streaks even when repeatedly used under various environmental conditions.

SUMMARY OF THE INVENTION

Accordingly, an object of the present invention is to provide a photoreceptor having the following advantages:

(1) good abrasion resistance;

(2) maintaining good charge properties even when repeatedly used for a long time, resulting in production of good images without undesired images such as black spots or white spots;

(3) producing good images without image defects such as black streaks or white streaks even after the photoreceptor is preserved under high temperature/humidity conditions; and (4) high sensitivity and long life.

Another object of the present invention is to provide an image forming apparatus and which can keep on producing images having good image qualities for a long time.

Yet another object of the present invention is to provide a process cartridge having a long life.

Briefly these objects and other objects of the present invention as hereinafter will become more readily apparent can be attained by a photoreceptor having an electroconductive substrate, and a photosensitive layer formed overlying the substrate, wherein the photosensitive layer includes a charge generation material, a charge transport polymer material, which includes triarylamine structure and which has a soft segment in its main chain, and a filler.

The charge transport polymer material preferably includes a charge transport polycarbonate compound.

In addition, the concentration of the filler in the surface portion (i.e., the farthest portion when viewed from the electroconductive substrate side) of the photosensitive layer is higher than in any other portion of the photosensitive layer.

The photosensitive layer preferably has a charge generation layer, and a charge transport layer which includes at least one of a layer including a low molecular charge transport material and a binder resin and a layer including a charge transport polymer material, and a layer including a charge transport polymer material and a filler.

The photoreceptor preferably includes at least one of charge transport polymer material having the following formulas of from (4) to (13).

(4)

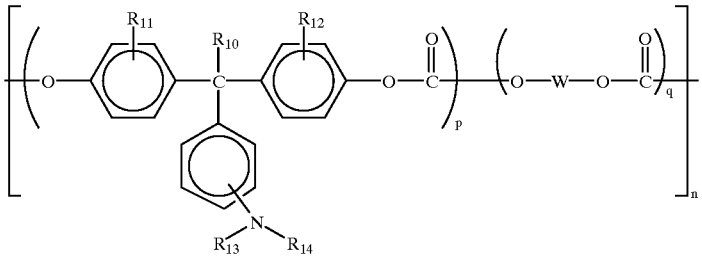

(5)

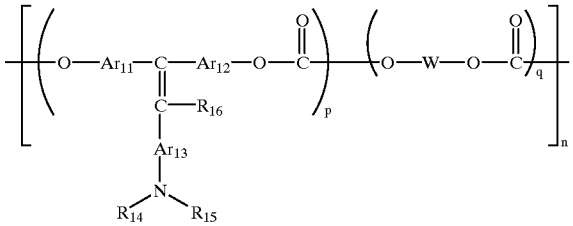

-continued
(6)
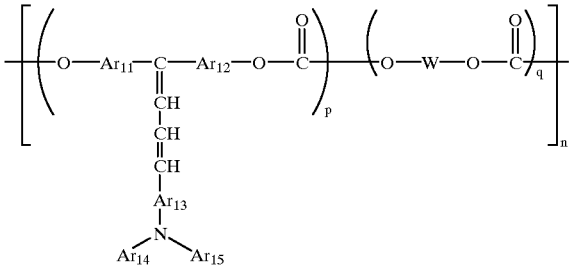
(7)
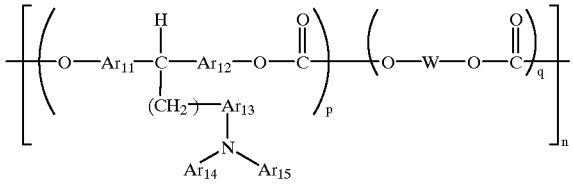
(8)
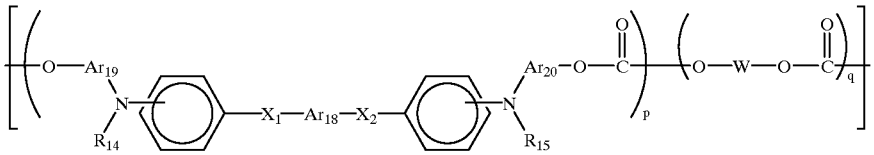
(9)
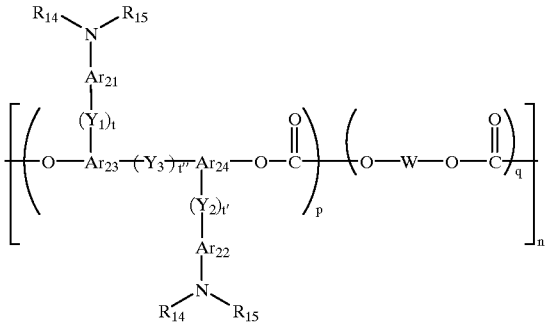
(10)
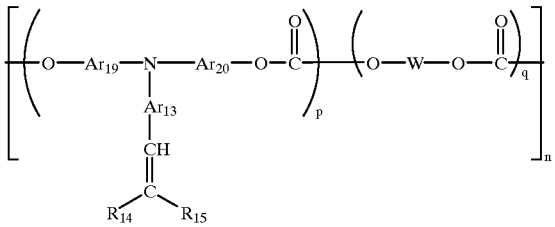
(11)
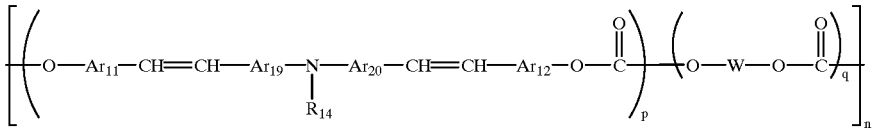

-continued (12)

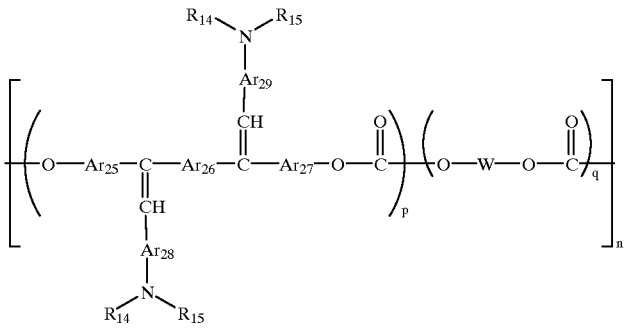

(13)

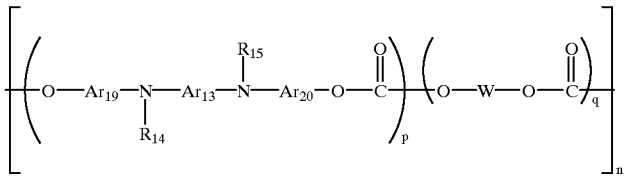

wherein R11, R12 and R13 independently represent a hydrogen atom, a substituted or unsubstituted alkyl group, or a halogen atom; R10 represents a hydrogen atom, or a substituted or unsubstitutedalkyl group; R14, R15, Ar14 and R15 independently represent a substituted or unsubstituted aryl group; R16 represents a hydrogen atom, a substituted or unsubstituted alkyl group, or a substituted or unsubstituted aryl group; Ar11, Ar12, Ar13, Ar18, Ar19, Ar20, Ar21, Ar22, Ar23, Ar24, Ar25, Ar26, Ar27, Ar28 and Ar29 independently represent an arylene group; p and q represent the component ratio and p is a number not less than 0.1 and less than 1 and q is a number greater than 0 and not greater than 0.9; n represents a number of repeating units and is an integer of from 5 to 5000; m is an integer of from 1 to 5; X1, X2, Y1, Y2 and Y3 independently represent a substituted or unsubstituted alkylene group, a substituted or unsubstituted cycloalkylene group, a substituted or unsubstituted alkyleneether group, an oxygen atom, a sulfur atom or a vinylene group; t, t' and t" is independently 0 or 1; and W represents a divalent aliphatic group, a divalent alicyclic group or a divalent group having the following formula (14):

(14)

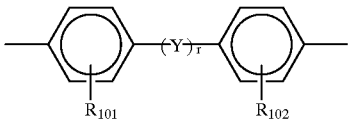

wherein R101 and R102 independently represent a substituted or unsubstituted alkyl group, a substituted or unsubstituted aryl group or a halogen atom; r is 0 or 1; and Y represents a linear, branched or cyclic alkylene group having from 1 to 12 carbon atoms, or —O—, —S—, —SO—, —$SO_2$—, —CO—, or —CO—O—Z—O—CO—, wherein Z represents a divalent aliphatic group.

In another aspect of the present invention, an image forming apparatus is provided which includes a photoreceptor, a charger, an imagewise light irradiating device, a developing device and a transfer device, wherein the photoreceptor is the photoreceptor mentioned above.

In yet another aspect of the present invention, an electrophotographic process cartridge is provided which includes the above-mentioned photoreceptor and at least one of a charger, a developing device, and a cleaning device and which can be attached to or detached from an image forming apparatus.

These and other objects, features and advantages of the present invention will become apparent upon consideration of the following description of the preferred embodiments of the present invention in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like of corresponding parts throughout and wherein.

DETAILED DESCRIPTION OF THE INVENTION

Figure 1:
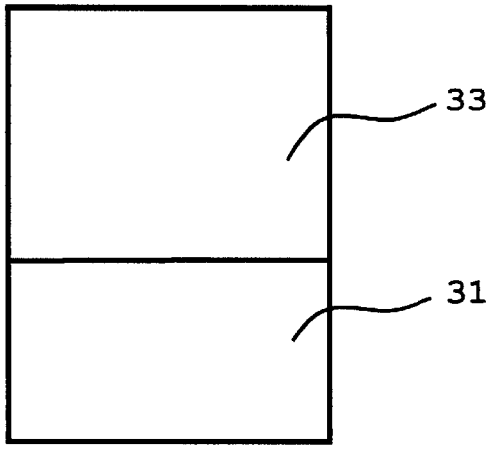
FIGS. 1 to 4 are schematic cross sectional views of embodiments of the photoreceptor of the present invention.

The present inventors have researched a photoreceptor having a photosensitive layer including a charge transport polymer material and a filler. As a result, it is discovered that a photoreceptor having a photosensitive layer including at least a charge generation material, a charge transport polymer material, which includes triarylamine structure and which has a soft segment in its main chain, and a filler, has excellent combination of the advantages mentioned above. In particular, the concentration of the filler in the surface portion of the photosensitive layer is preferably higher than in any other portion thereof to obtain a photoreceptor having good abrasion resistance.

The reason for the improvement is not clear but is considered to be as follows.

A photosensitive layer of an organic photoreceptor is prepared by coating on a substrate a coating liquid in which constituents of the photosensitive layer are dissolved or dispersed and then drying the coated liquid. In general, when a coating liquid including a charge transport polymer material is coated and dried, the surface of the charge transport polymer material is distorted during the coating and drying process, resulting in generation of internal stress in the resultant layer including the charge transport polymer material. In particular, when a particulate filler having a particle diameter of from 0.01 to 1 $\mu$m is present in the layer, the polymer chains of a charge transport polymer material in the vicinity of a particle of the filler are unnaturally intertwined because the charge transport moiety of the polymer chains is bulky, resulting in distortion of the polymer material. Therefore, an excessive stress is applied to the charge transport polymer material present in the vicinity of the filler, namely an excessive stress is locally applied to the photosensitive layer. The stressed points in the photosensitive layer tend to be easily damaged mechanically and chemically. Thus, charges formed on the stressed points tend to leak, resulting in formation of undesired images such as black or white spots. In addition, it is considered that micro cracks are easily formed in the stressed points of the photosensitive layer.

The charge transport polymer material for use in the photoreceptor of the present invention has a block including a triaryl amine structure in a main chain or a side chain thereof. In addition, the charge transport polymer material has a block including a soft segment structure, which is different from the block having a triaryl amine structure, in the main chain thereof.

The soft segment means the structure, —OWOCO—, as shown in formulas (4) to (13). It is considered that this structure not only imparts flexibility to the charge transport polymer material, but also relaxes the internal stress generated in the photosensitive layer when the layer is formed. Therefore formation of micro cracks on the surface of the layer can be avoided.

In particular, in a layer including a charge transport polymer material and a filler, the soft segment structure intertwines the filler. Therefore, the charge transport polymer material, which is in an unmovable state due to the gathering of the bulky charge transport structure, is relaxed. This is because the soft segment makes a space in the charge transport polymer material, and thereby the charge transport polymer material can rotate and vibrate, resulting in relaxation of the internal stress. Accordingly, a layer in which cracks are hardly formed and which is dense (i.e., which hardly has a free space) can be formed.

The thus prepared dense layer does not cause local charge leak. Therefore, even when an image is formed using a reverse development, undesired black spot images are hardly formed in the background area of the images. In addition, even when image forming processes are repeatedly performed, black spot images are hardly formed.

Next, the photoreceptor of the present invention will be explained referring to drawings.

FIG. 1 is a schematic cross section of an embodiment of the photoreceptor of the present invention. A photosensitive layer 33 including at least a charge generation material, a charge transport material and a filler is formed on an electroconductive substrate 31. The filler may be included uniformly in the layer. However, since the filler for use in the photoreceptor of the present invention has high electric resistance and does not have a charge transport function, it is preferable that the concentration of the filler in the surface portion of the layer 33 is greater than any other portion of the layer 33 to prevent the photosensitivity of the photosensitive layer from being deteriorated due to charge trapping.

Figure 2:
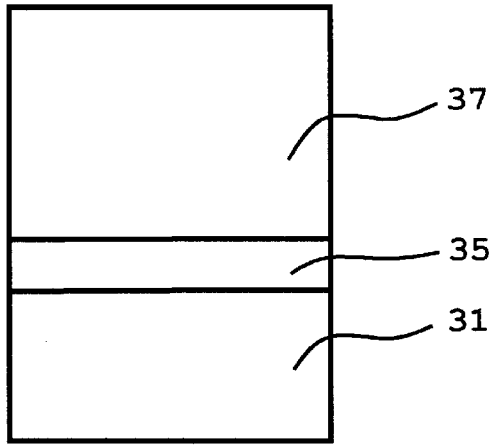

FIG. 2 is a schematic cross section of another embodiment of the photoreceptor of the present invention. A charge generation layer 35 including a charge generation material as a main component, and a charge transport layer 37 including a charge transport polymer material and a filler are overlaid on an electroconductive substrate 31 in this order. Similarly to the case mentioned above in FIG. 1, it is preferable that the concentration of the filler in the surface portion of the charge transport layer 37 is greater than in any other portion of the charge transport layer 37.

Figure 3:
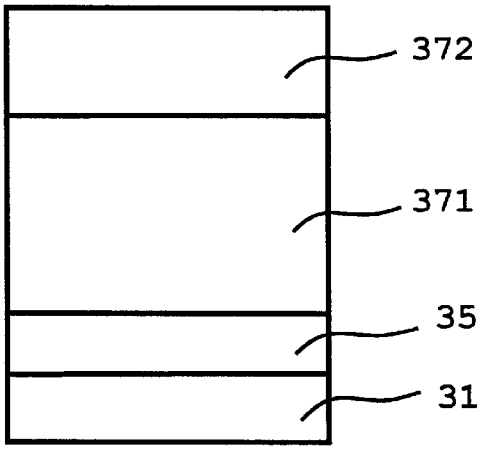
Figure 4:
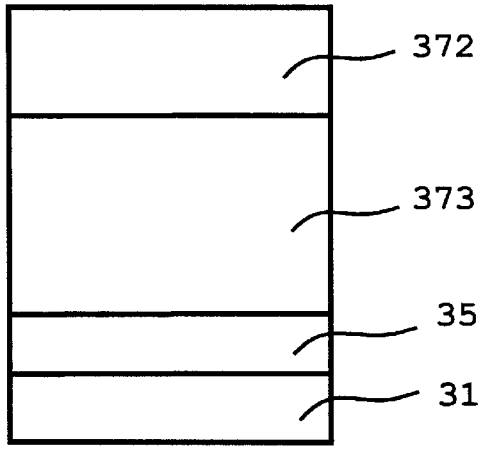

The photoreceptors as shown in FIGS. 3 and 4 have a plurality of charge transport layers which are overlaid.

In FIG. 3, a charge generation layer 35 including a charge generation material as a main component, a first charge transport layer 371 including a low molecular charge transport material and a binder resin, and a second charge transport layer 372 including a charge transport polymer material and a filler are overlaid on an electroconductive substrate 31 in this order.

In FIG. 4, a charge generation layer 35 including a charge generation material as a main component, a first charge transport layer 373 including a charge transport polymer material as a main component, and a second charge transport layer 372 including a charge transport polymer material and a filler are overlaid on an electroconductive substrate 31 in this order.

Suitable substrates for use in the photoconductor of the present invention includes materials having a volume resistivity less than $10^{10}$ $\Omega\cdot$m. Specific examples of such materials include drums and sheets which are made of a metal such as aluminum, nickel, chrome, nickel-chrome alloys, copper, silver, gold, platinum and the like, or a plastic or paper whose surfaces are coated with one of the metals mentioned above, or a metal oxide such as tin oxide and indium oxide, by a vacuum evaporation method or a sputtering method. In addition, a plate of a metal such as aluminum, aluminum alloys, nickel stainless steel and the like, and a tube which is made, for example, by preparing a rough tube of one of the metals mentioned above by an extruding or a drawing method and then treating the surface of the rough tube by cutting, super finishing and/or polishing can also be used. Further, an endless nickel belt and stainless belt, which are disclosed in, for example, Japanese Laid-Open Patent Publication No. 52-36016, can also be used as the electroconductive substrate 31.

In addition, substrates, which are made by coating on the above-mentioned supporters a coating liquid in which an electroconductive powder is dispersed in a binder resin solution, can also be used as the electroconductive substrate 31. Specific examples of the electroconductive powder include carbon black, acetylene black, metal powders such as aluminum, nickel, iron, nickel-chromium alloys, copper, zinc, and silver; and metal oxides such as electroconductive titanium oxides, electroconductive tin oxides, ITO and the like. Specific examples of the binder resin include thermoplastic resins, thermosetting resins and photo-crosslinking resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole resins, acrylic resins, silicone resins, epoxy resins, melamine resins, urethane resins, phenolic resins, alkyd resins and the like resins. The electroconductive layer can be formed by coating on a support a coating liquid in which one or more of the electroconductive powders and one or more of the binders resin are dispersed or dissolved in a proper solvent such as tetrahydrofuran, dichloromethane, 2-butanone, and toluene.

Further, substrates, which are made by forming an electroconductive layer on a cylindrical supporter using a heat shrinkable tube in which one or more of the electroconductive powders mentioned above are included in a resin such as polyvinyl chloride, polypropylene, polyester, polystyrene, polyvinylidene chloride, polyethylene, chlorinated rubbers, and fluorine-containing resins, can also be used as the electroconductive substrate 31.

Next, the photosensitive layer will be explained in detail. The photosensitive layer may be constituted of a single layer or a multi layers. At first, the photosensitive layer including a charge generation layer 35 and a charge transport layer 37 will be explained for only explanation purpose.

The charge generation layer 35 will be explained.

The charge generation layer 35 includes a charge generation material as a main component, and optionally includes a binder resin. As the charge generation material, inorganic charge generation materials and organic charge generation materials can be used. Suitable inorganic charge generation materials include crystalline selenium, amorphous selenium, selenium-tellurium compounds, selenium-tellurium-halogen compounds, selenium-arsenic compounds, amorphous silicon and the like materials. Suitable amorphous silicons include ones in which a dangling bond is terminated with a hydrogen atom or a halogen atom, or in which a boron atom or a phosphorus atom is doped.

Specific examples of the organic charge generation materials include phthalocyanine pigments such as metal phthalocyanine and metal-free phthalocyanine, azulenium pigments, squaric acid methine pigments, azo pigments including a carbazole skeleton, azo pigments including a triphenylamine skeleton, azo pigments including a diphenylamine skeleton, azo pigments including a dibenzothiophene skeleton, azo pigments including a fluorenone skeleton, azo pigments including an oxadiazole skeleton, azo pigments including a bisstilbene skeleton, azo pigments including a distyryloxadiazole skeleton, azo pigments including a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole and the like known materials.

These charge transport materials can be used alone or in combination.

Specific examples of the binder resin, which is optionally used in the charge generation layer 35, include polyamide resins, poly urethane resins, epoxy resins, polyketone resins, polycarbonate resins, polyarylate resins, silicone resins, acrylic resins, polyvinyl butyral resins, polyvinyl formal resins, polyvinyl ketone resins, polystyrene resins, poly-N-vinylcarbazole resins, polyacrylamide resins, and the like. These binder resins can be used alone or in combination. In addition, one or more charge transport materials may be included in the charge generation layer 35.

Suitable charge transport materials for use in the charge generation layer 35 include positive hole transport materials and electron transport materials.

Specific examples of such electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, and the like compounds. These electron transport materials can be used alone or in combination.

Specific examples of such positive hole transport materials include electron donating materials such as oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives, thiophene derivatives, and the like. These positive hole transport materials can be used alone or in combination.

Suitable methods for forming the charge generation layer 35 include thin film forming methods in a vacuum, and casting methods.

Specific examples of such thin film forming methods in a vacuum include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods useful for forming the charge generation layer 35 include, for example, the following steps;

(1) preparing a coating liquid by mixing one or more inorganic or organic charge generation materials mentioned above with a solvent such as tetrahydrofuran, cyclohexanone, dioxane, dichloroethane, butanone and the like, and if necessary, together with a binder resin and an additives, and then dispersing the materials with a ball mill, an attritor, a sand mill or the like;

(2) coating on a substrate the coating liquid, which is diluted if necessary, by a dip coating method, a spray coating method, a bead coating method, a ring coating method or the like method; and (3) drying the coated liquid to form a charge generation layer.

The thickness of the charge generation layer 35 is preferably from about 0.01 to about 5 μm, and more preferably from about 0.05 to about 2 μm.

Next, the charge transport layer 37 will be explained in detail.

The charge transport layer 37 may be constituted of a single layer as shown in FIG. 2, or may be constituted of a plurality of layers as shown in FIGS. 3 and 4. In the present invention, it is essential for the charge transport layer 37 that a charge transport polymer material having a soft segment in its main chain, and a triarylamine structure, and a filler is included at least in the surface portion of the charge transport layer 37.

In the single-layer type charge transport layer 37, a charge transport polymer material and a filler may be included in the entire layer. However, since the fillers for use in the present invention has a high electric insulation property as mentioned later, it is preferable that the concentration of the filler in the layer 37 increases from the bottom toward the surface of the layer 37. Such a layer can be formed, for example, by coating a first coating liquid, whose filler concentration is relatively low, on a charge generation layer 35, and then successively coating a second coating liquid, whose filler concentration is higher than the first coating liquid, on the first charge transport layer, which is not yet perfectly dried. If desired, these operations may be repeated.

In a case of the single-layer type charge transport layer 37, it is preferable that the constituents in the bottom portion of the layer 37 are the same as those in the surface portion of the layer 37. Therefore, the single-layer type charge transport layer 37 inevitably include a charge transport polymer material and a filler in both the bottom portion and the surface portion.

Then the multi-layer type charge transport layer as shown in FIGS. 3 and 4 will be explained. In FIGS. 3 and 4, a first charge transport layer 371 or 373 is constituted of materials which may be the same as or different from the materials constituting a second charge transport layer 372. It is preferable to use materials in the first charge transport layer 371 or 373, which are different from materials used in the second charge transport layer 372, to separate the function of the charge transport layer into the first and second charge transport layer.

The constitution of the charge transport layer is not particularly limited, if the layer has includes the essential requirements, i.e., if the surface portion of the charge transport layer includes a charge transport polymer material, which includes triarylamine structure and which has a soft segment in its main chain, and a filler.

An embodiment of the photoreceptor of the present invention is illustrated in FIG. 3. The first charge transport layer 371 includes a low molecular charge transport material and a binder resin as main components. Specific examples of these constituents can be selected from known materials. Therefore, the charge transport layer 371 can be manufactured at a relatively low cost. In addition, since various known materials can be used for the charge transport layer 371, there is a wide choice when the layer 371 is designed. Further, since the first charge transport layer 371 is overlaid with the second charge transport layer 372, the concentration of a low molecular charge transport material in the first charge transport layer 371 can be increased. Such increase of the concentration of a low molecular charge transport material cannot be performed in photoreceptors having the conventional structure because the charge transport layer, which is an uppermost layer and which includes the low molecular charge transport material, is easily abraded if the concentration of a low molecular charge transport material is increased. Therefore, the photoreceptor of the present invention can respond to high speed image forming processes because of having high mobility such that any conventional photoreceptors cannot achieve.

In the photoreceptor as shown in FIG. 4, the first charge transport layer 373 includes a charge transport polymer material as a main component. This type of photoreceptor has an advantage in that when the second charge transport layer 372 is formed thereon, the first charge transport layer 373 is hardly damaged by the coating of the second transport layer 372. In addition, the most important feature of the charge transport polymer materials is such that charge transport moieties can be included in the polymer materials at a high concentration. When a charge transport polymer material is used in the first charge transport layer 373, it is not necessarily needed for the charge transport polymer material to include a soft segment therein. Therefore, the concentration of charge transport moieties can be further increased in the first charge transport layer 373. The charge transporting ability of the first charge transport layer 373 is almost the same as that of the first charge transport layer 371 in which a low molecular charge transport material is included at a high concentration. However, the charge transport layer 373 has an advantages over the charge transport layer 371 in that the layer 373 tends not to be damaged (i.e., dissolved or crystallized) when the second charge transport layer 372 is formed.

Next, the charge transport layer 37 will be explained in detail. At first, the multi-layer type charge transport layer will be explained.

The first charge transport layer 371 as shown in FIG. 3 is formed by coating a coating liquid in which a charge transport material is dissolved or dispersed in a solvent together with a binder resin, and then drying the coated liquid. Suitable binder resins for use in the first charge transport layer 371 include polycarbonate resins such as bisphenol A type polycarbonate resins, bisphenol Z type polycarbonate resins, bisphenol C type polycarbonate resins, and copolymers of these polycarbonate resins; polyarylate resins, polysulfone resins, polyester resins, methacrylic resins, polystyrene resins, vinyl acetate resins, epoxy resins, phenoxy resins, and the like resins. Among these resins, polycarbonate resins having the following formula (2) or (3) are preferably used.

(2)

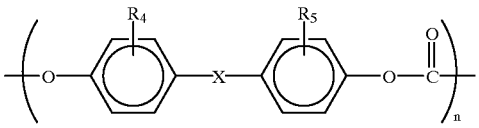

(3)

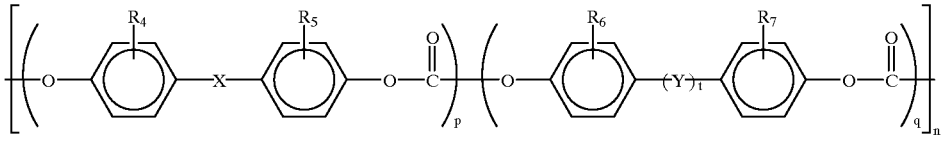

wherein R4, R5, R6 and R7 independently represent a hydrogen atom, a substituted or unsubstituted alkyl group, a halogen atom or a substituted or unsubstituted aryl group; X represents a divalent aliphatic group, or a divalent alicyclic group; t is 0 or 1; and Y represents a linear, branched or ring alkylene group having from 1 to 12 carbon atoms, —O—, —S—, —SO—, —$SO_2$—, —CO—, or —CO—O—Z—O—CO— (Z represents a divalent aliphatic group) or a group having the following formula:

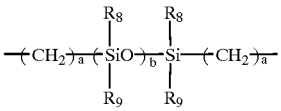

wherein a is an integer of from 1 to 20, and b is an integer of from 1 to 2000; and R8 and R9 independently represent a substituted or unsubstituted alkyl group, or a substituted or unsubstituted aryl group, wherein R6 and R7 may be the same to or different from each other, and R8 and R9 may be the same or different from each other; and p is a number of from 0.1 to 1, q is a number of from 0 to 0.9, and n, which is a repeating number, is an integer of from 5 to 5000.

These polycarbonate resins have good toughness and film-formability. In addition, these resins having formula (2) or (3) have good compatibility with low molecular charge transport materials.

Specific examples of the polycarbonate resins having formula (2) or (3) include resins having one of the following formulas, but are not limited thereto.

(I-1)

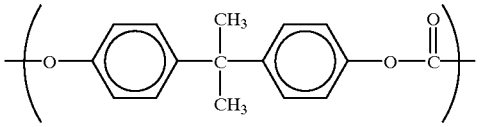

(I-2)

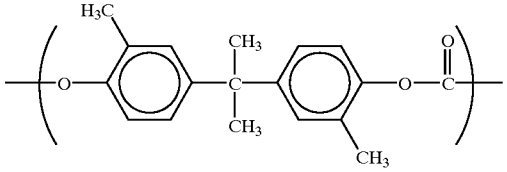

(I-3)

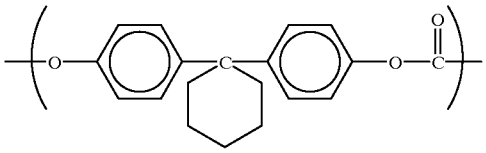

(I-4)

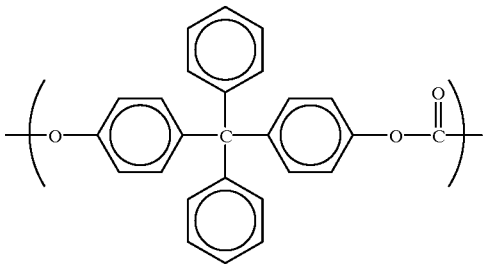

(I-5)

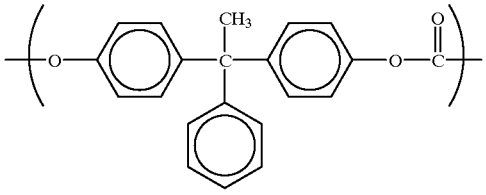

(I-6)

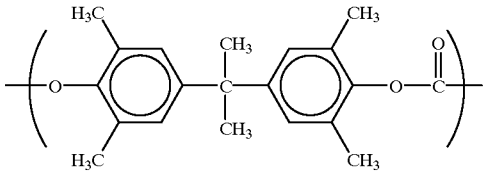

(I-7)

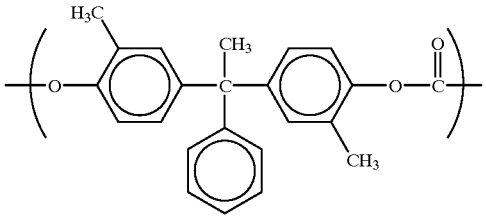

(I-8)

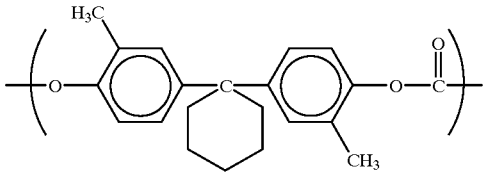

(I-9)

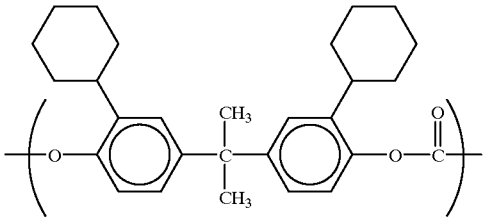

(I-10)

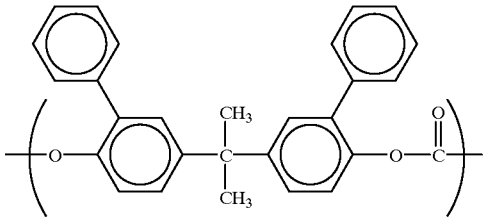

-continued
(I-11)
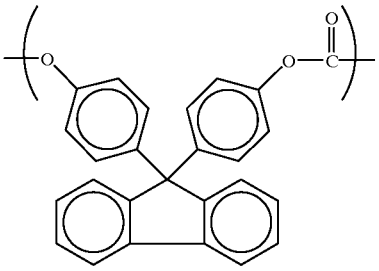
(I-12)
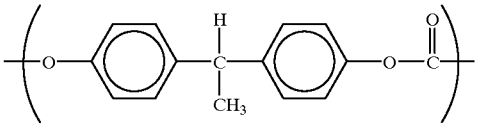
(I-13)
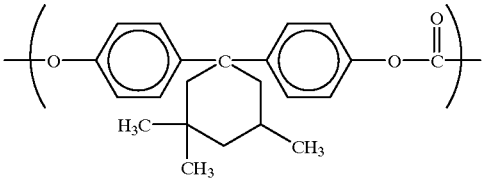
(I-14)
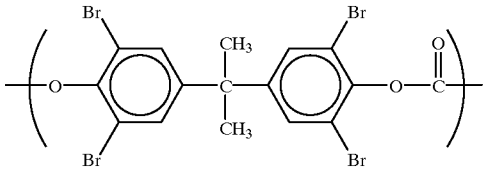
(I-15)
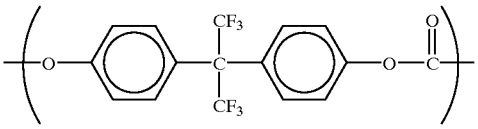
(I-16)
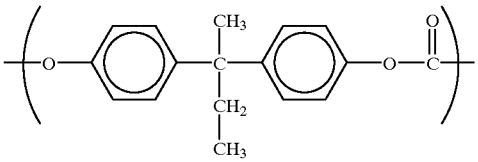
(I-17)
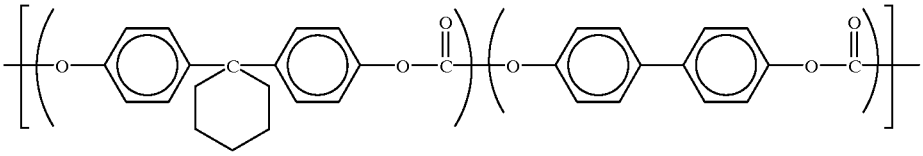
(I-18)
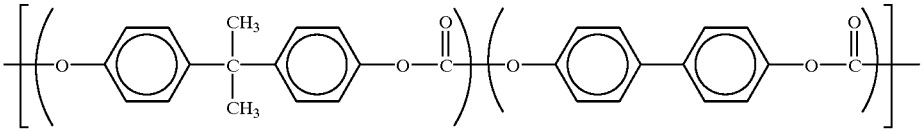
(I-19)
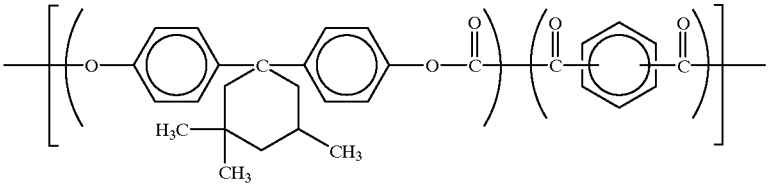
(polyesterpolycarbonate)
(I-20)
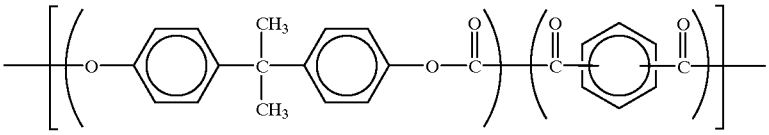
(polyesterpolycarbonate)

-continued (I-21)

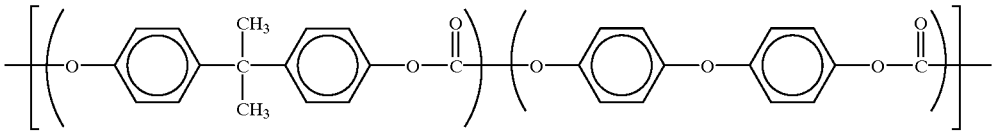

(I-22)

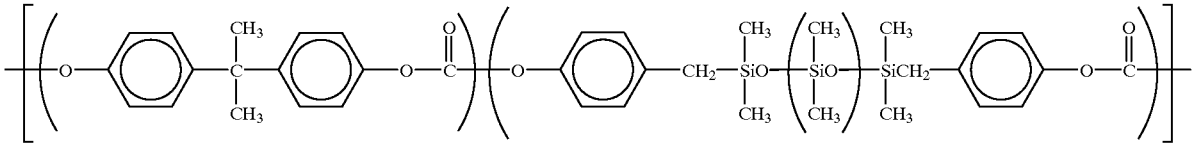

These resins are used alone or in combination.

Suitable low molecular charge transport materials for use in the charge transport layer 371 include oxazole derivatives, oxadiazole derivatives (disclosed in Japanese Laid-Open Patent Publications Nos. 52-139065 and 52-139066), imidazole derivatives, triphenylamine derivatives (Japanese Patent Application No. 1-77839), benzidine derivatives (disclosed in Japanese Patent Publication No. 58-32372), α-phenylstilbene derivatives (disclosed in Japanese Laid-Open Patent Publication No.57-73075), hydrazone derivatives (disclosed in Japanese Laid-Open Patent Publications Nos. 55-154955, 55-156954, 55-52063 and 56-81850), triphenyl methane derivatives (disclosed in Japanese Patent Publication No. 51-10983), anthracene derivatives (disclosed in Japanese Laid-Open Patent Publication No. 51-94829), styryl derivatives (disclosed in Japanese Laid-Open Patent Publications Nos. 56-29245 and 58-198043), carbazole derivatives (disclosed in Japanese Laid-Open Patent Publication No. 58-58552), pyrene derivatives (Japanese Patent Application No. 2-94812), and the like compounds.

Among these compounds, low molecular charge transport materials having the following formula (1) are preferably used because of having high mobility, good photosensitive properties and good compatibility with the binder resins mentioned above.

(1)

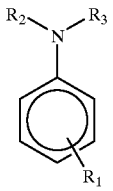

wherein R1 represents a hydrogen atom, a substituted or unsubstituted alkyl group, a halogen atom, or a substituted or unsubstituted aryl group; and R2 and R3 independently represent a substituted or unsubstituted aryl group.

Suitable substituted or unsubstituted alkyl groups for use as R1 include linear or branched alkyl groups having from 1 to 12 carbon atoms, preferably from 1 to 8, and more preferably from 1 to 4 carbon atoms. These alkyl groups can include a fluorine atom, a hydroxy group, a cyano group, an alkoxy group having from 1 to 4 carbon atoms, a phenyl group, a halogen atom, a phenyl group substituted with an alkyl group or an alkoxy group each having from 1 to 4 carbon atoms. Specific examples of the substituted or unsubstituted alkyl groups for use as R1 include a methyl group, an ethyl group, a n-propyl group, an i-propyl group, a t-butyl group, a s-butyl group, a n-butyl group, an i-butyl group, a trifluoromethyl group, a 2-hydroxyethyl group, an 2-cyanoethyl group, a 2-ethoxyethyl group, a 2-methoxyethyl group, a benzyl group, a 4-chlorobenzyl group, a 4-methylbenzyl group, a 4-methoxybenzyl group, a 4-phenylbenzyl group, and the like groups. As a halogen atom, a fluorine atom, a chlorine atom, a bromine atom, and an iodine atom are exemplified.

R2 and R3 independently represent a substituted or unsubstituted aryl group. Specific examples of the substituted or unsubstituted aryl group are as follows: aromatic hydrocarbon groups such as a styryl group, a phenyl group; condensed polycyclic groups such as a naphthyl group, a pyrenyl group, a 2-fluorenyl group, a 9,9-dimethyl-2-fluorenyl group, an azulenyl group, an anthryl group, a triphenylenyl group, a chrysenyl group, a fluorenylidenephenyl group, and a 5H-dibenzo[a,d]cycloheptenylidenephenyl group; non-condensed polycyclic groups such as a biphenyl group, and a terphenyl group; and heterocyclic groups such as a thienyl group, a benzothienyl group, a furyl group, a benzofuranyl group, and a carbazolyl group.

The aryl groups mentioned above may include one or more of the following groups as a substituent.

(1) a halogen atom, a trifluoromethyl group, a cyano group, and a nitro group.

(2) alkyl groups mentioned above for use as R1, R2 and R3.

(3) alkoxy groups represented by —$OR_{105}$ (R105 represents an alkyl group defined above in (2)). Specific examples of such alkoxy groups include a methoxy group, an ethoxy group, a n-propoxy group, an i-propoxy group, a t-butoxy group, a n-butoxy group, a s-butoxy group, an i-butoxy group, a 2-hydroxyethoxy group, a 2-cyanoethoxy group, a benzyloxy group, a 4-methylbenzyloxy group, and a trifluoromethoxy group.

(4) aryloxy groups. Specific examples of the aryl group include a phenyl group and a naphthyl group. The aryl group may include a substituent such as alkoxy groups having from 1 to 4 carbon atoms, alkyl groups having from 1 to 4 carbon atoms, and halogen atoms. Specific examples of the aryloxy groups include a phenoxy group, a 1-naphthyloxy group, a 2-naphthyloxy group, a 4-methylphenoxy group, a 4-methoxyphenoxy group, a 4-chlorophenoxy group, and a 6-methyl-2-naphthyloxy group.

(5) substituted mercapto groups and arylmercapto groups such as a methylthio group, an ethylthio group, a phenylthio group, and a p-methylphenylthio group.

(6) amino groups substituted with one or more alkyl groups. Specific examples of the alkyl groups include the alkyl groups defined above in (2). Specific examples of the amino groups substituted with one or more alkyl groups include a dimethylamino group, a diethylamino group, a N-methyl-N-propylamino group, and a N,N-dibenzylamino group.

(7) acyl groups such as an acetyl group, a propionyl group, a butylyl group, a malonyl group, and a benzoyl group.

Specific examples of the low molecular charge transport materials having formula (1) include compounds having the following formula, but are not limited thereto:

(II-1)

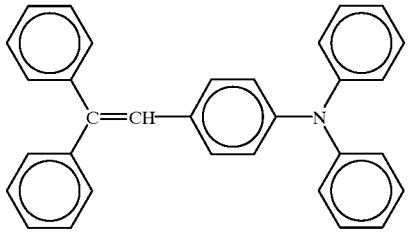

(II-2)

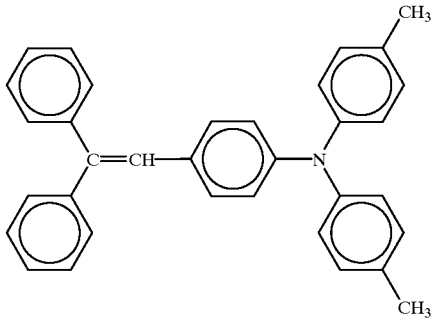

(II-3)

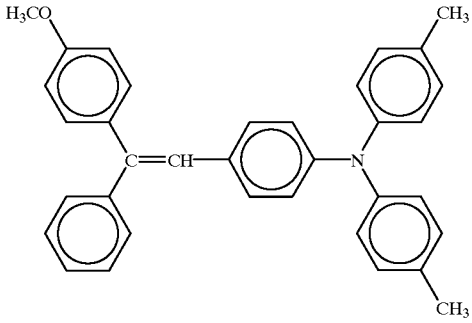

-continued (II-4)

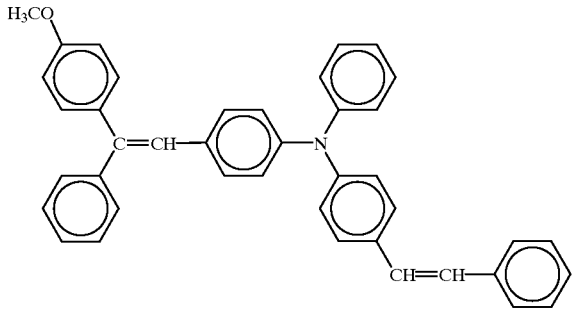

(II-5)

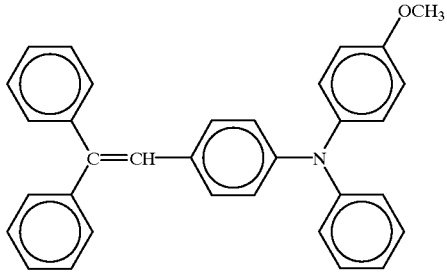

(II-6)

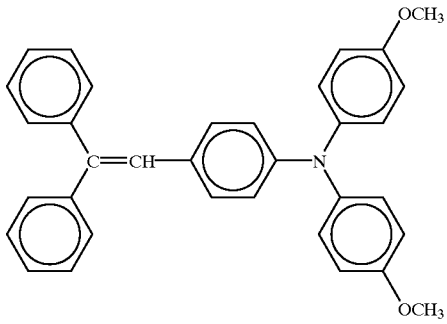

(II-7)

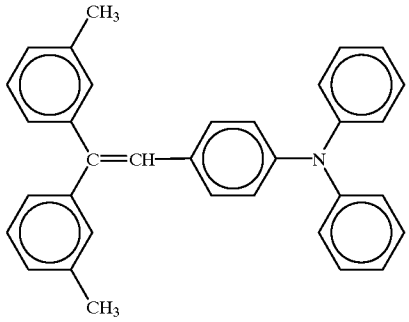

(II-8)
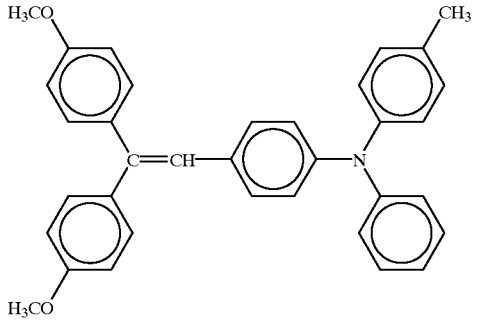
(II-9)
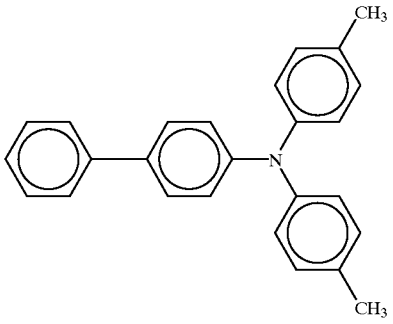
(II-10)
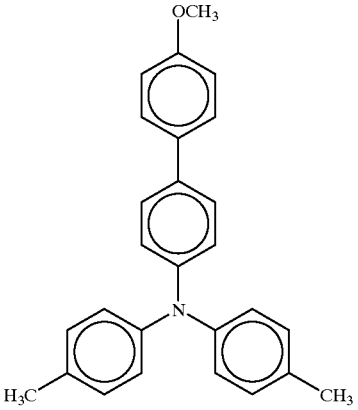
(II-11)
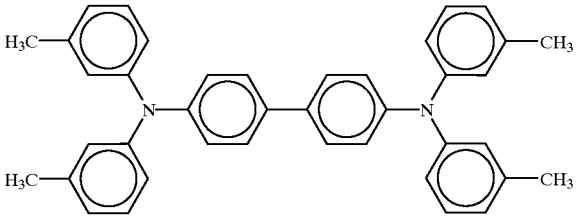
(II-12)
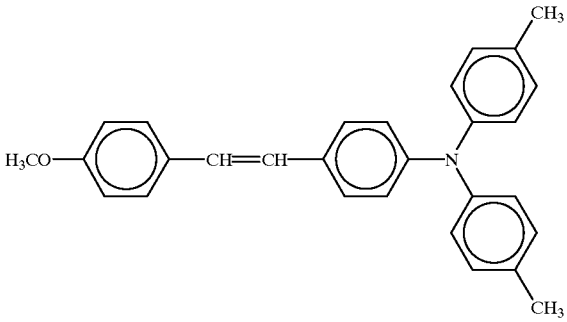
(II-13)
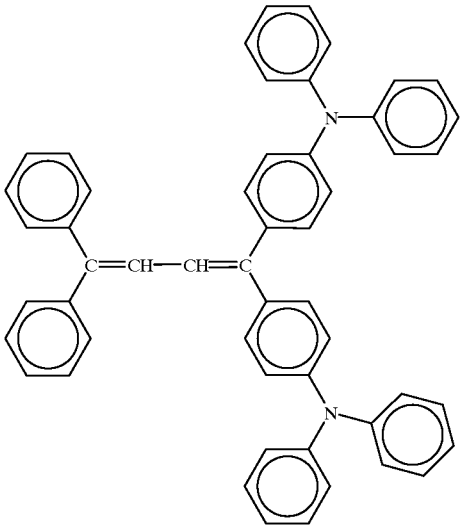
(II-14)
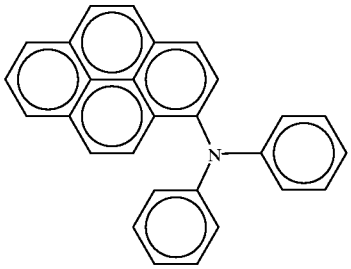
(II-15)
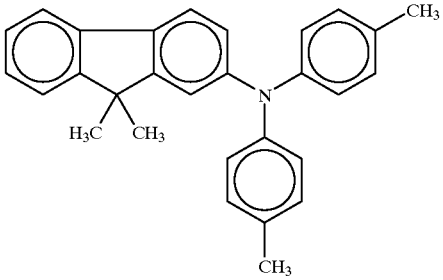

-continued (II-16)

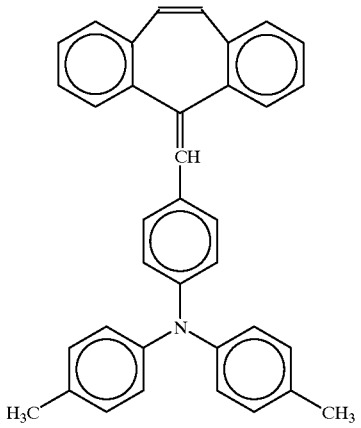

The concentration of these low molecular charge transport materials in the first charge transport layer 371 is from 20 to 300 parts by weight, and preferably from 40 to 150 parts by weight, per 100 parts by weight of the binder resin included therein. The thickness of the first charge transport layer 371 is preferably not greater than 30 $\mu$m to produce images having good resolution and to provide a photoreceptor having high response. The lower limit of the thickness, which depends on the system for which the resultant photoreceptor is used (in particular, the surface potential needed for the photoreceptor used), is preferably not less than about 5 $\mu$m.

Suitable solvents for use in the coating liquid for forming the first charge transport layer 371 include tetrahydrofuran, dioxane, toluene, dichloromethane, monochlorobenzene, dichlorobenzene, dichloroethane, cyclohexanone, methyl ethyl ketone, acetone and the like solvents. These solvents can be used alone or in combination.

Next, the first charge transport layer 373 as shown in FIG. 4 will be explained. The first charge transport layer 373 includes a charge transport polymer material as a main component. The layer 373 is typically formed by coating a coating liquid in which a charge transport polymer material is dissolved in a solvent, and then drying the coated liquid.

Suitable charge transport polymer materials for use in the layer 373 include the compounds which have a triarylamine group in their main chain or side chain (i.e., have one of formulas of from 4 to 13 mentioned below), and known charge transport polymer materials such as acrylic resins having a triarylamine skeleton which are disclosed in Japanese Laid-Open Patent Publication No. 5-202135, and polyvinyl carbazole. These charge transport polymer materials can be used alone or in combination. In addition, a binder resin, and a low molecular charge transport material can be added, if desired. The thickness of the first charge transport layer 373 is preferably not greater than 30 $\mu$m from the viewpoint of light response of the resultant photoreceptor and resolution of the produced images. The lower limit of the thickness, which depends on the system for which the resultant photoreceptor is used (in particular, the surface potential needed for the photoreceptor used), is preferably not less than about 5 $\mu$m.

Suitable solvents for use in the coating liquid for forming the first charge transport layer 373 include tetrahydrofuran, dioxane, toluene, dichloromethane, monochlorobenzene, dichlorobenzene, dichloroethane, cyclohexanone, methyl ethyl ketone, acetone and the like solvents. These solvents can be used alone or in combination.

Next, the charge transport polymer layer 372 as shown in FIGS. 3 and 4 will be explained. The layer 372 is an uppermost layer of the photosensitive layer, and includes a filler and a charge transport polymer material having at least a soft segment in its main chain and a triarylamine structure.

Suitable charge transport polymer materials for use in the layer 372 include known charge transport polymer materials, which include triarylamine structure and have a soft segment in their main chain and which can exert the effects of the present invention. Among these charge transport polymer materials, charge transport polymer materials having one of the following formulas (4) to (13) are preferably used.

(4)

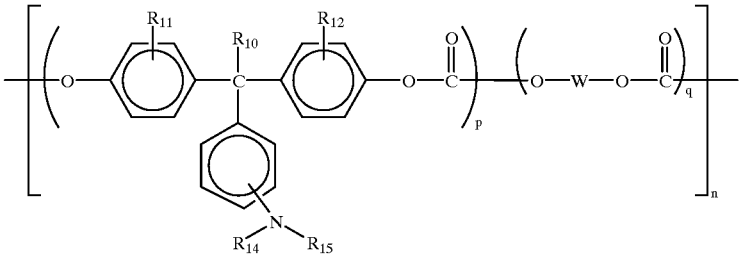

(5)

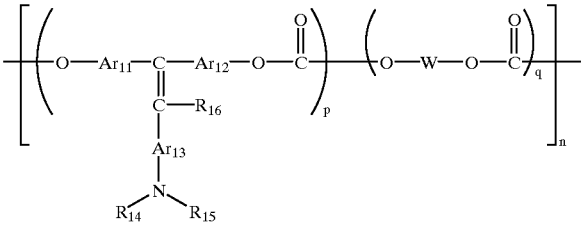

-continued
(6)
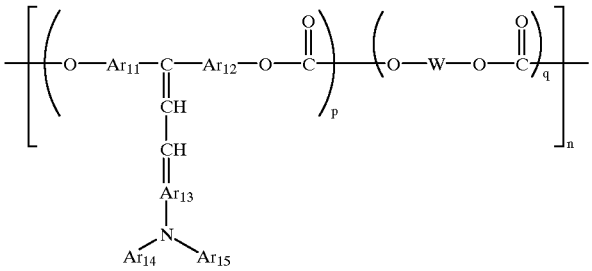
(7)
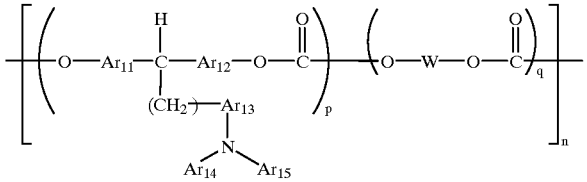
(8)
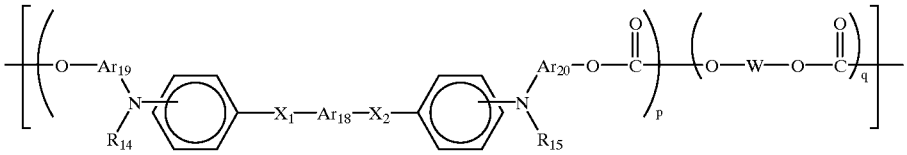
(9)
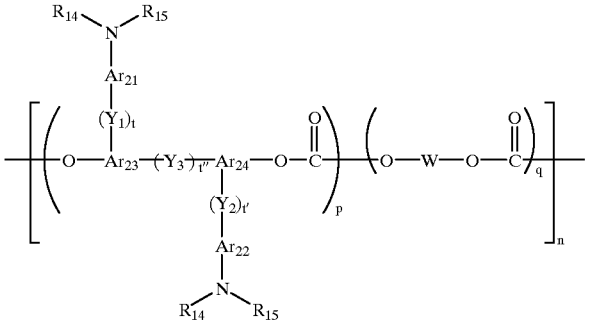
(10)
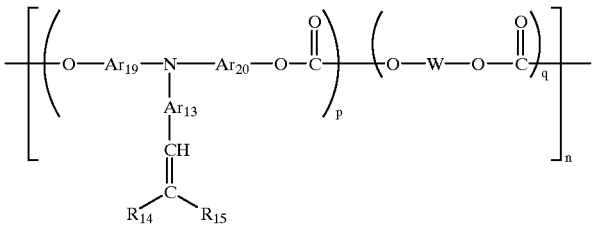
(11)
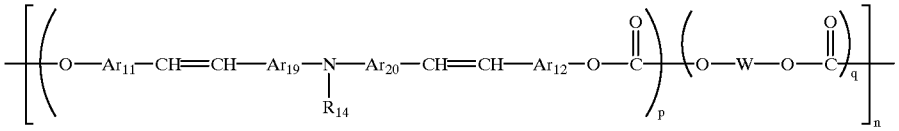

-continued (12)

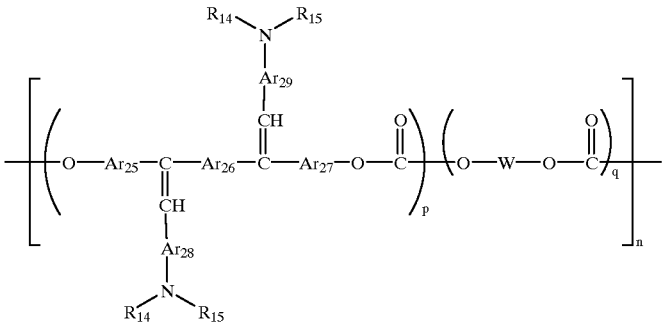

(13)

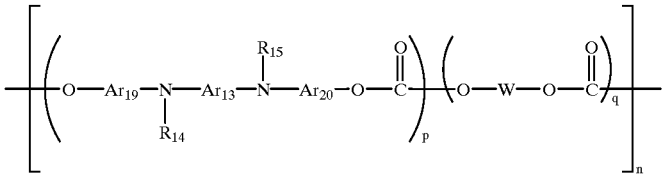

wherein R11, R12 and R13 independently represent a hydrogen atom, a substituted or unsubstituted alkyl group, or a halogen atom; R10 represents a hydrogen atom, or a substituted or unsubstituted alkyl group; R14 and R15 independently represent a substituted or unsubstituted aryl group; R16 represents a hydrogen atom, a substituted or unsubstituted alkyl group, or a substituted or unsubstituted aryl group; Ar11, Ar12, Ar13, Ar18, Ar19, Ar20, Ar21, Ar22, Ar23, Ar24, Ar25, Ar26, Ar27, Ar28 and Ar29 independently represent an arylene group; p is a number not less than 0.1 and less than 1 and q is a number greater than 0 and not greater than 0.9; n represents a number of repeating units and is an integer of from 5 to 5000; m is an integer of from 1 to 5; X1, X2, Y1, Y2 and Y3 independently represent a substituted or unsubstituted alkylene group, a substituted or unsubstituted cycloalkylene group, a substituted or unsubstituted alkyleneether group, an oxygen atom, a sulfur atom or a vinylene group; t, t' and t" is independently 0 or 1; and W represents a divalent aliphatic group, a divalent alicyclic group or a divalent group having the following formula (14):

(14)

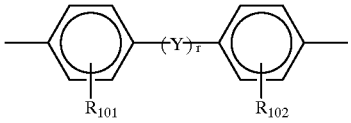

wherein R101 and R102 independently represent a substituted or unsubstituted alkyl group, a substituted or unsubstituted aryl group or a halogen atom; r is 0 or 1; and Y represents a linear, branched or cyclic alkylene group having from 1 to 12 carbon atoms, or —O—, —S—, —SO—, —$SO_2$—, —CO—, or —CO—O—Z—O—CO—, wherein Z represents a divalent aliphatic group.

Specific examples of such charge transport polymer materials include compounds having one of the following formulae:

(III-1)

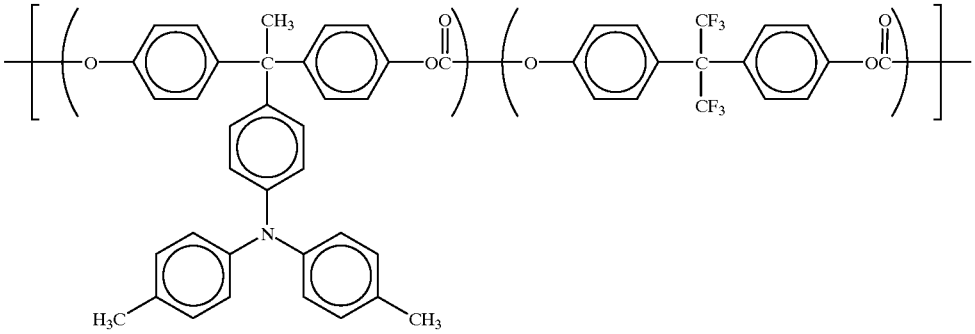

-continued
(III-2)
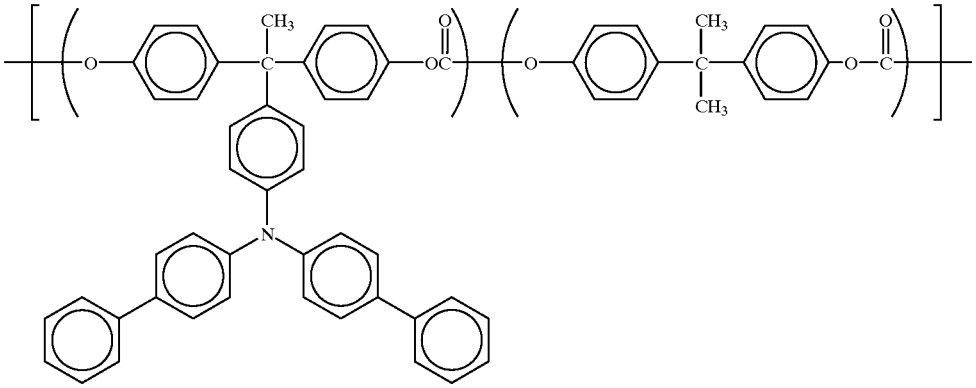
(III-3)
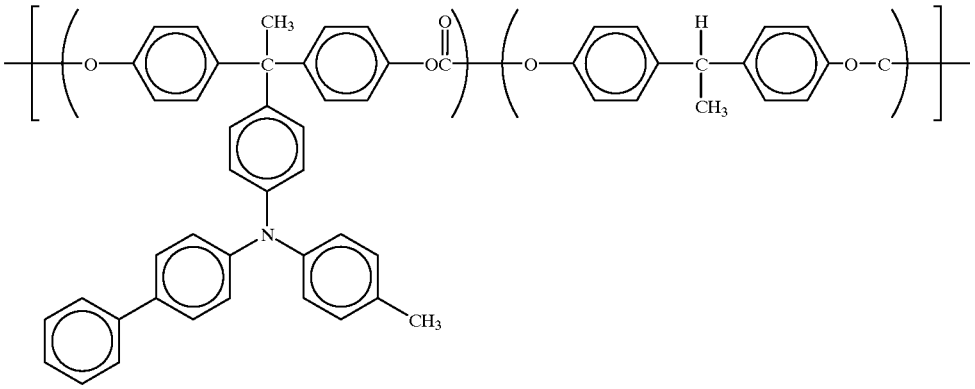
(III-4)
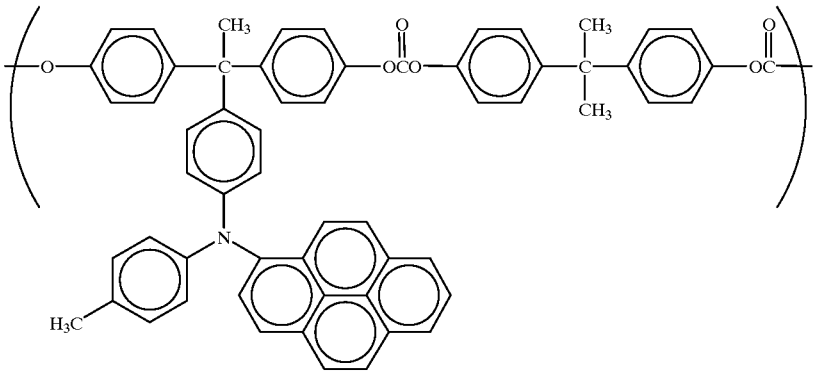
(III-5)
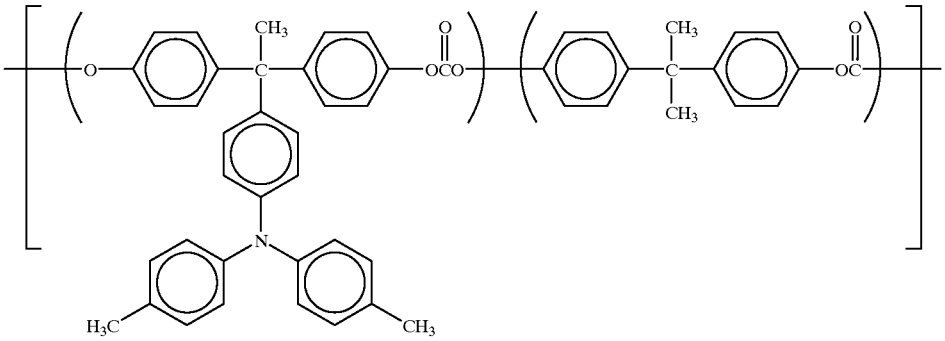

-continued
(III-6)
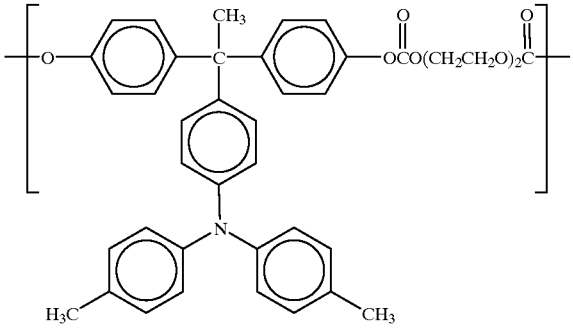
(III-7)
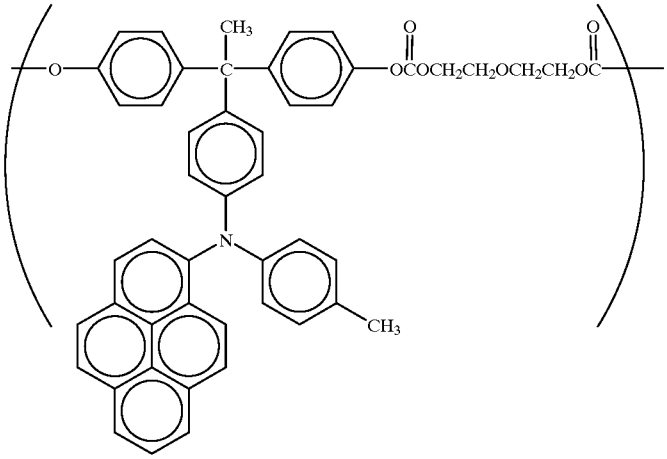
(III-8)
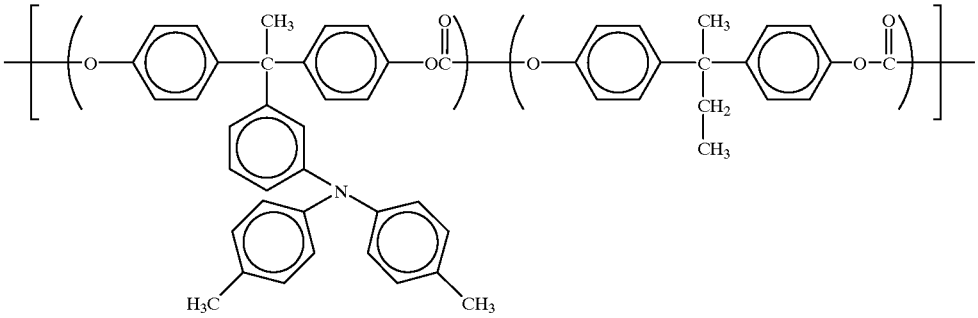
(III-9)
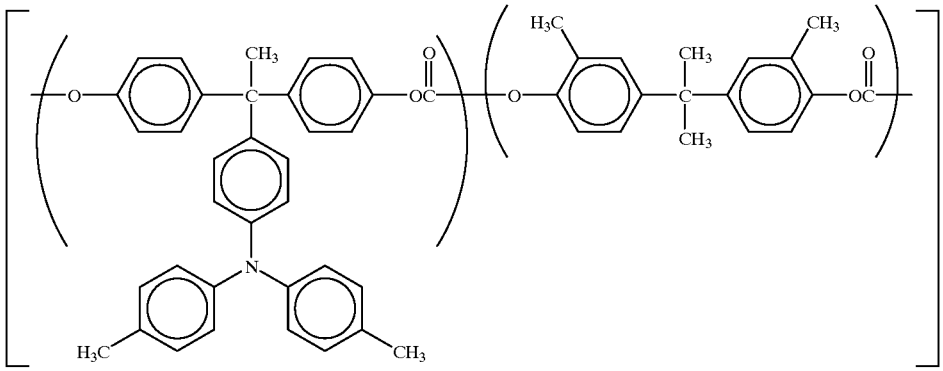

-continued
(III-10)
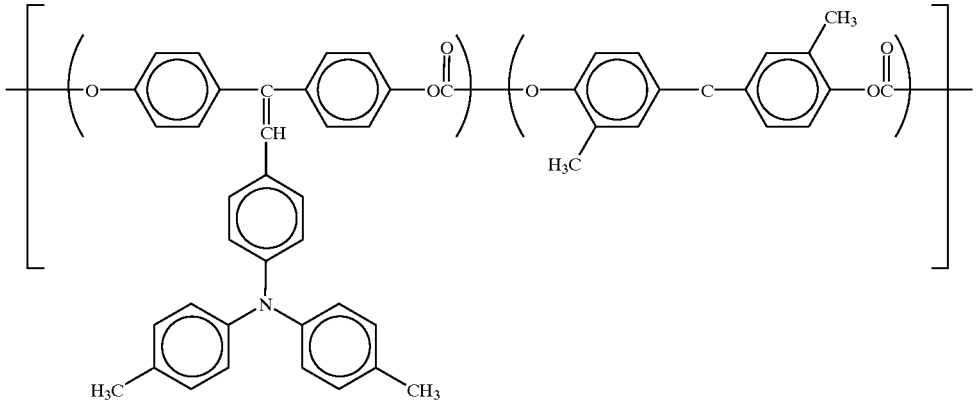
(III-11)
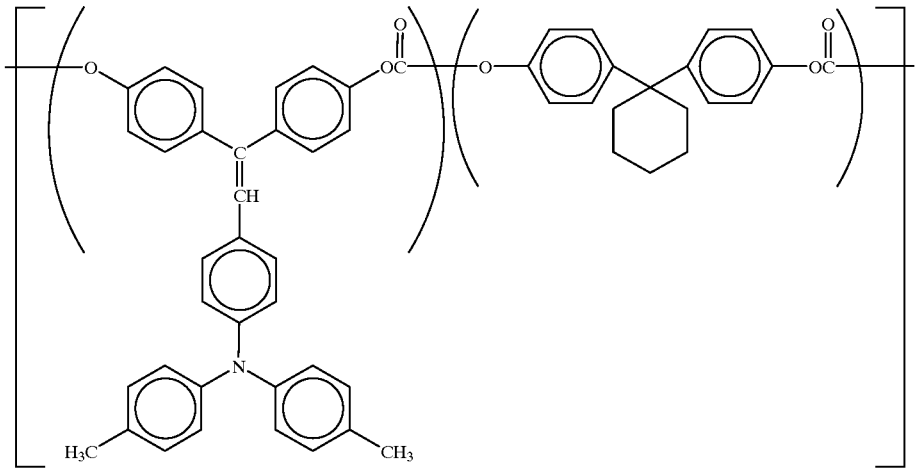
(III-12)
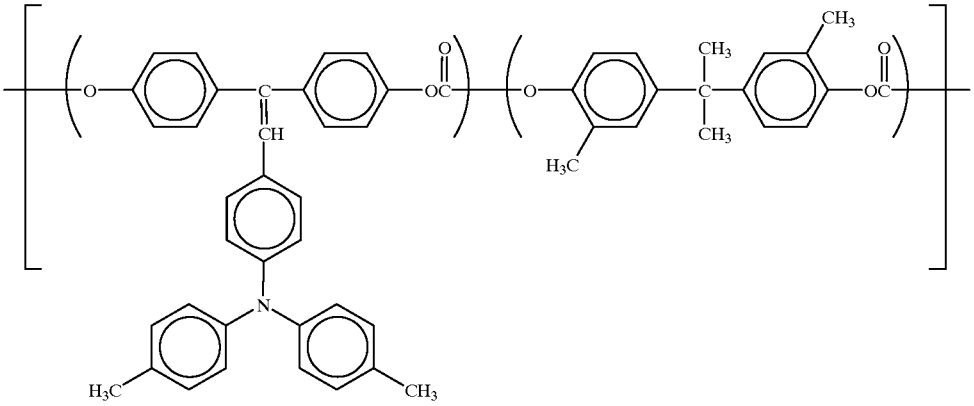

-continued
(III-13)
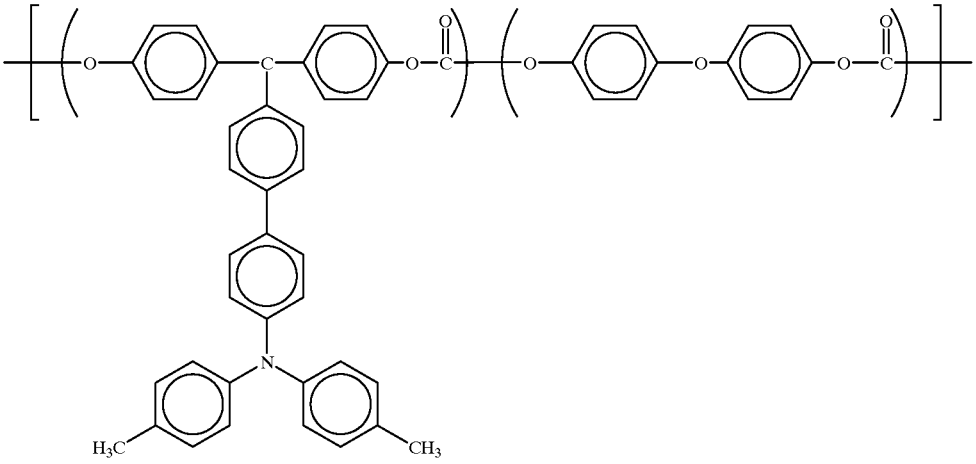
(III-14)
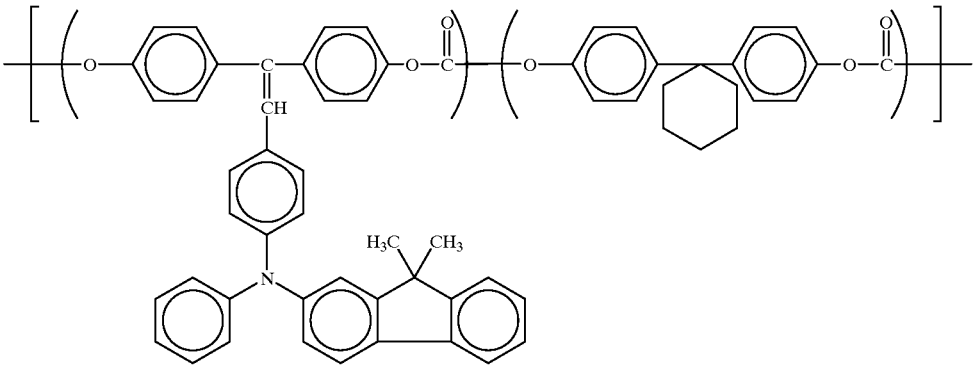
(III-15)
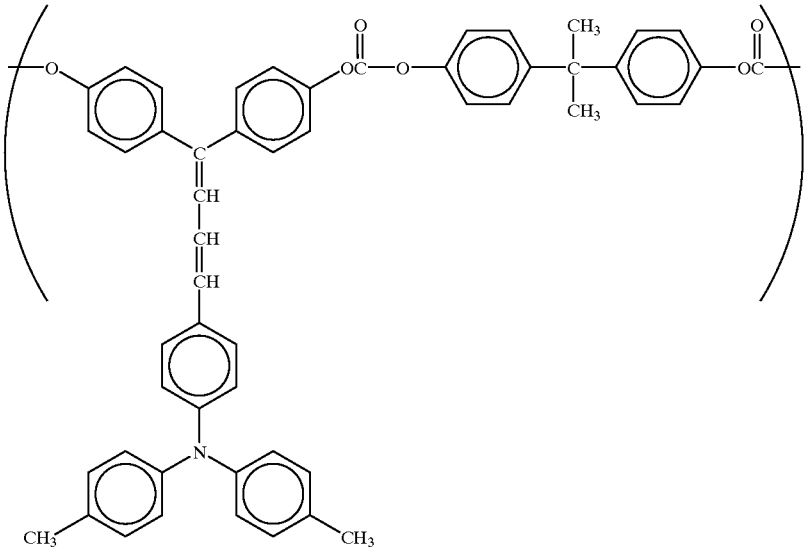

-continued
(III-16)
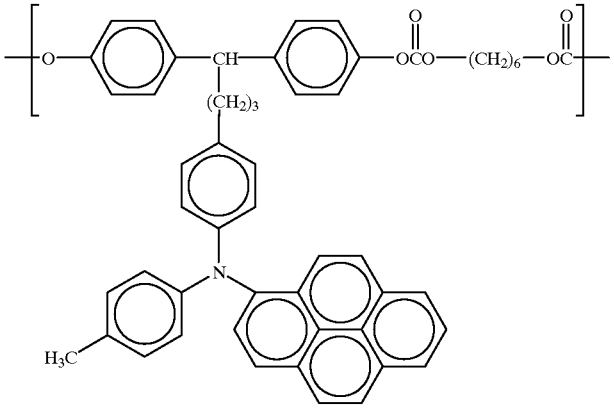
(III-17)
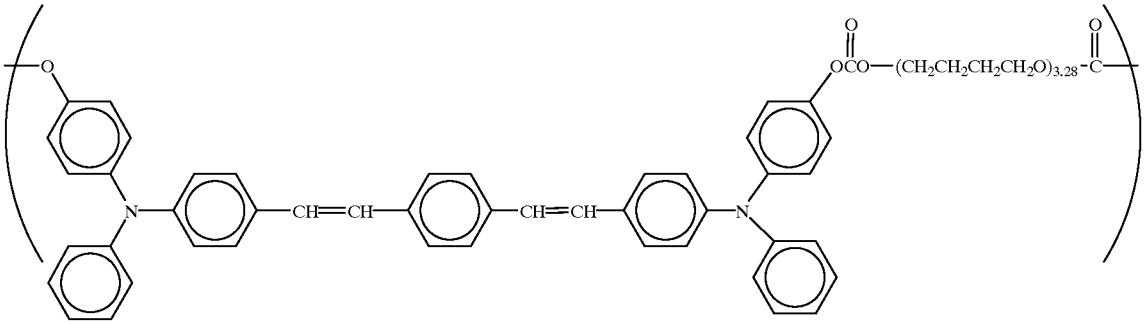
(III-18)
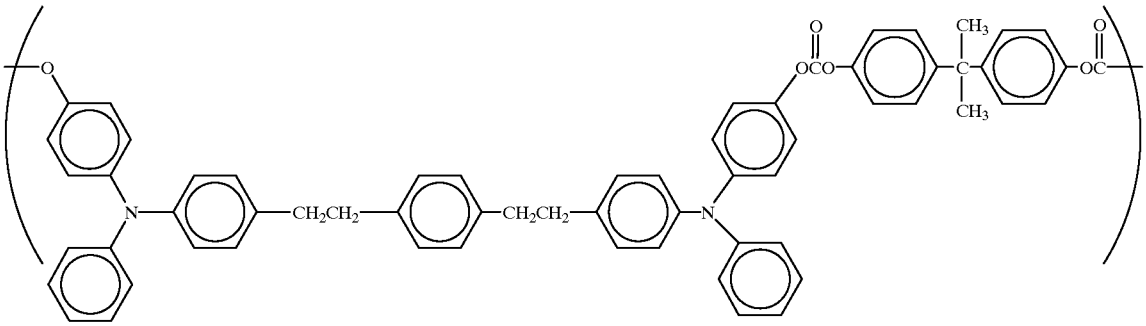

-continued
(III-19)
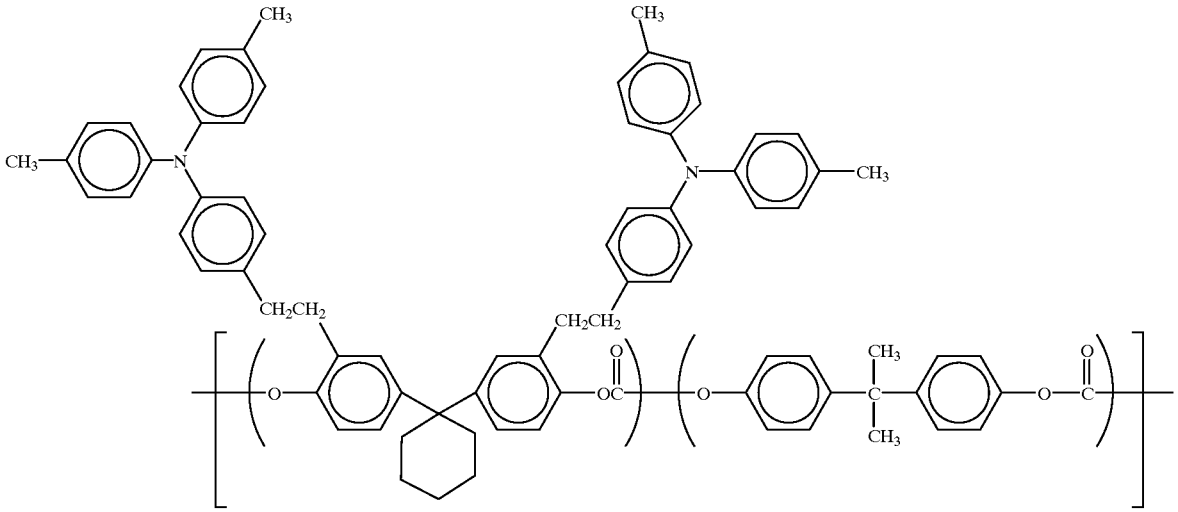
(III-20)
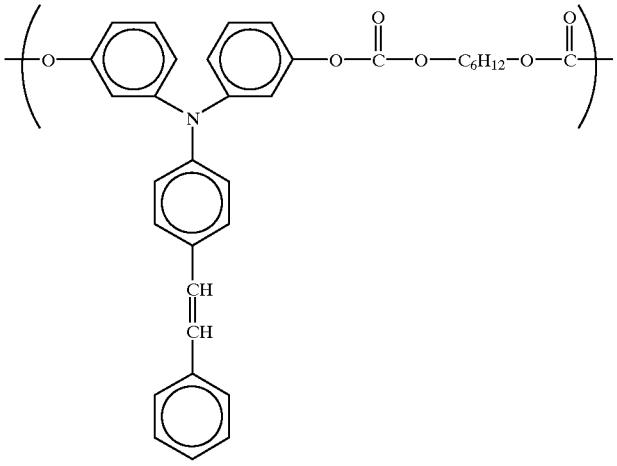
(III-21)
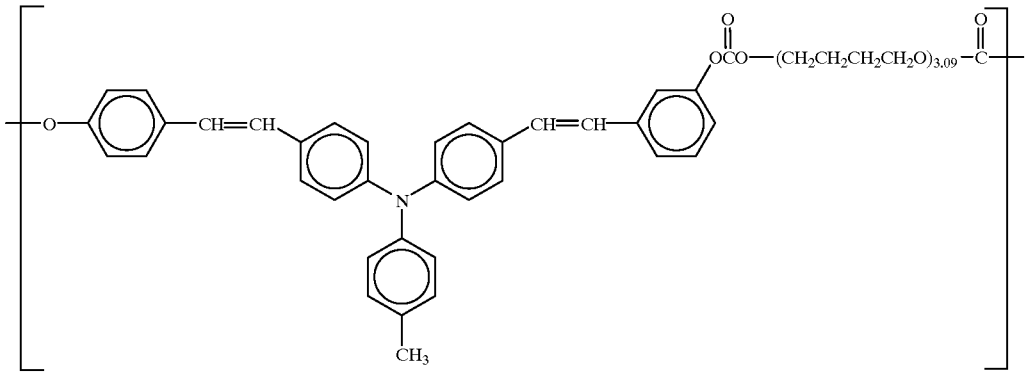

-continued
(III-22)
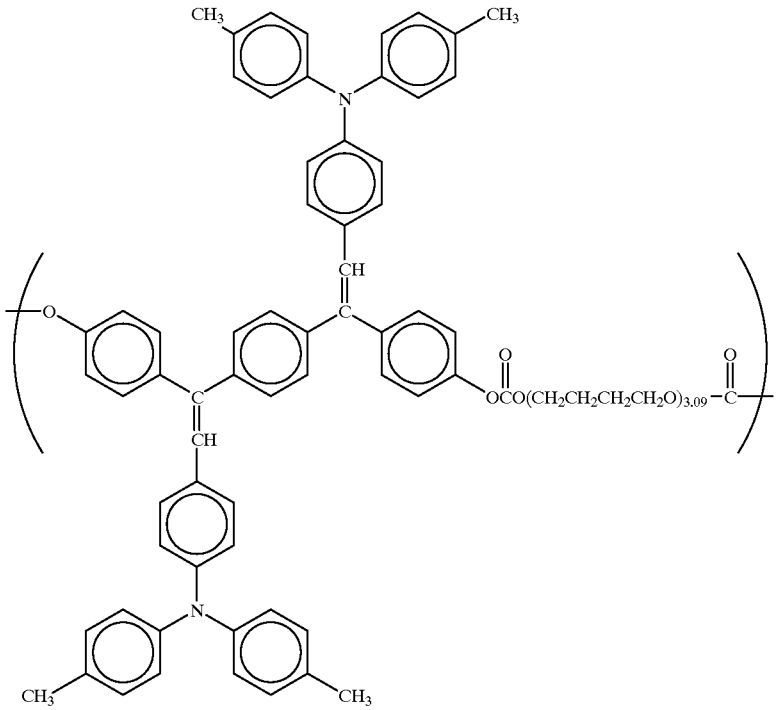
(III-23)
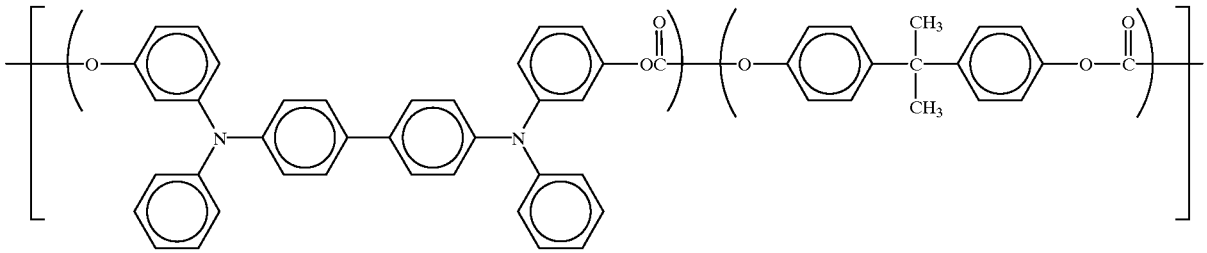
(III-24)
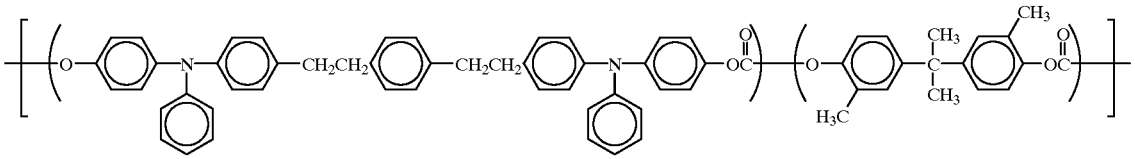

-continued
(III-25)
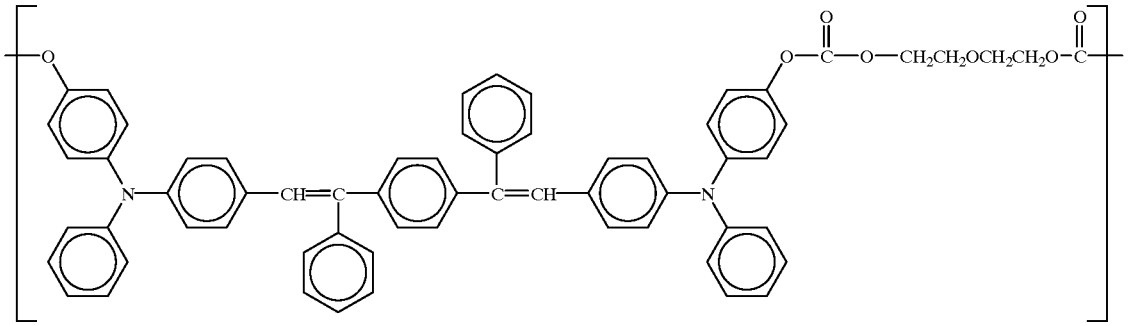
(III-26)
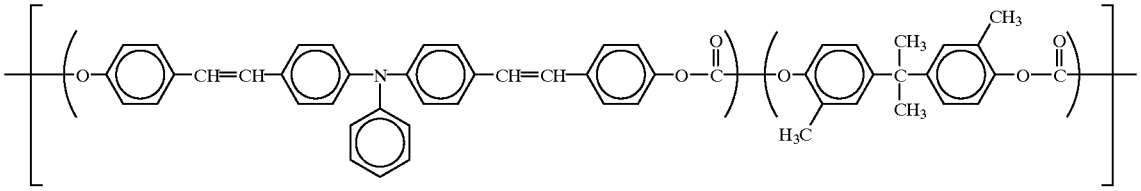
(III-27)
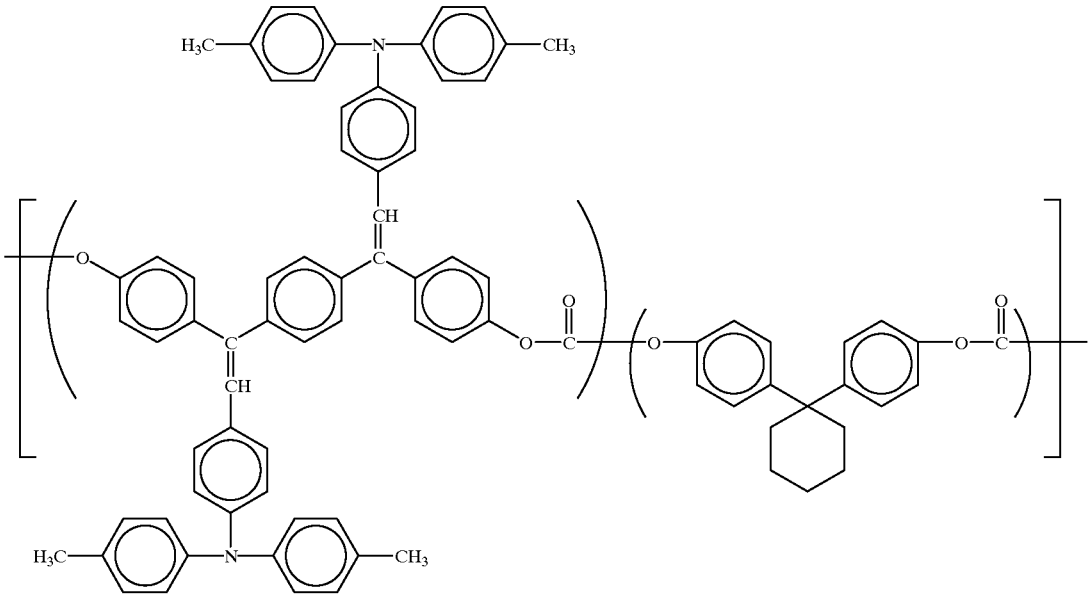

-continued
(III-28)
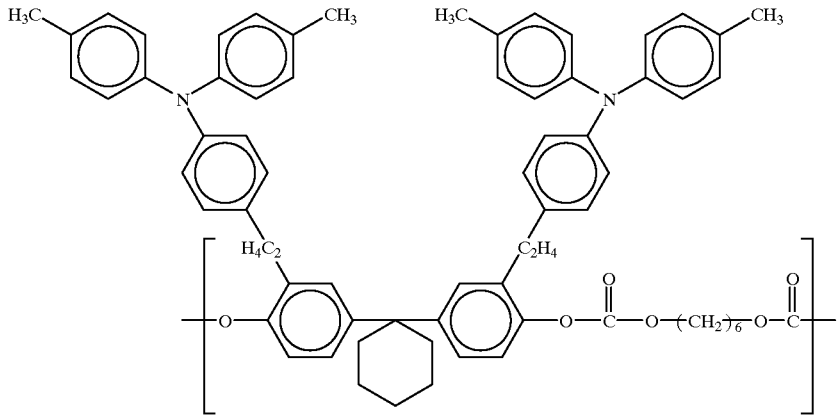
(III-29)
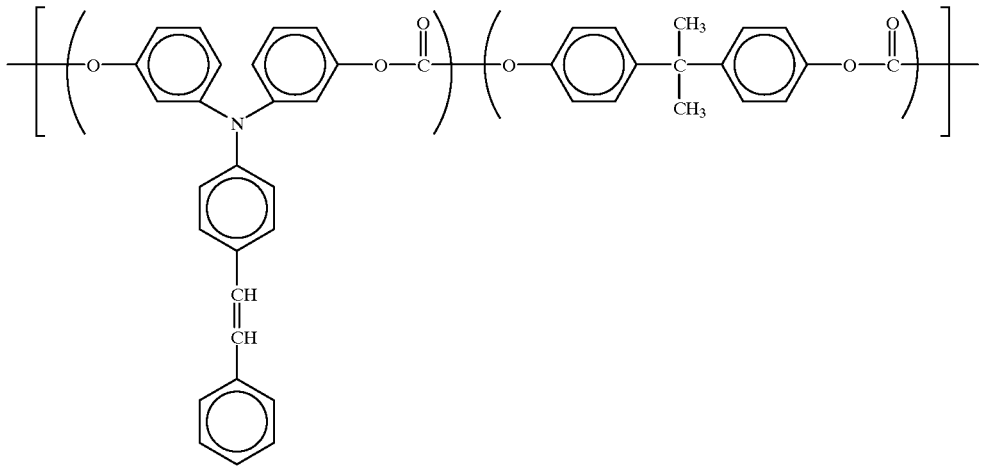
(III-30)
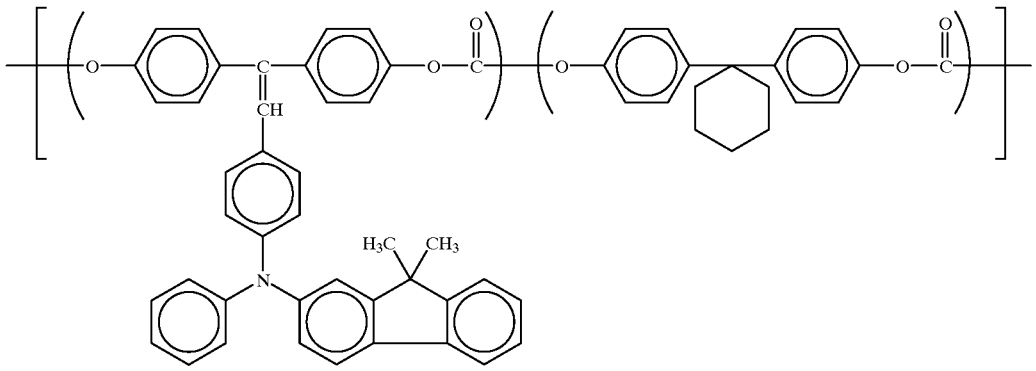

-continued (III-31)

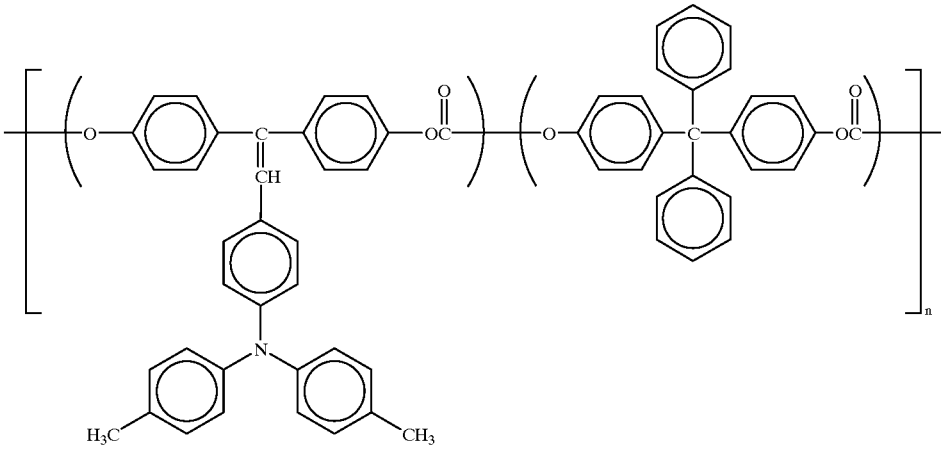

(III-32)

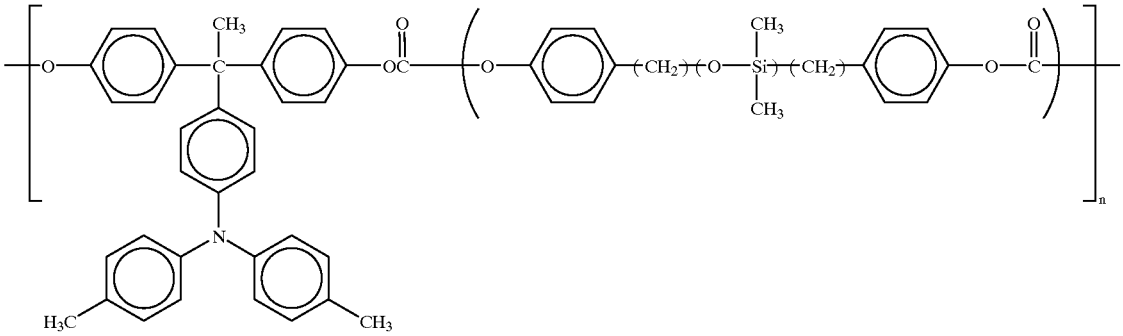

(III-33)

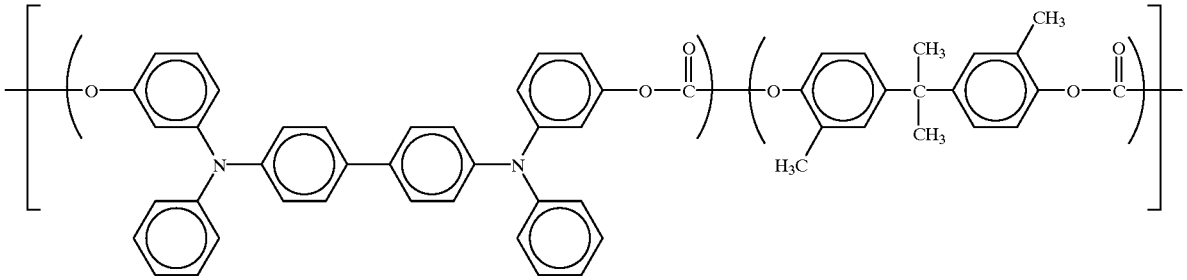

(III-34)

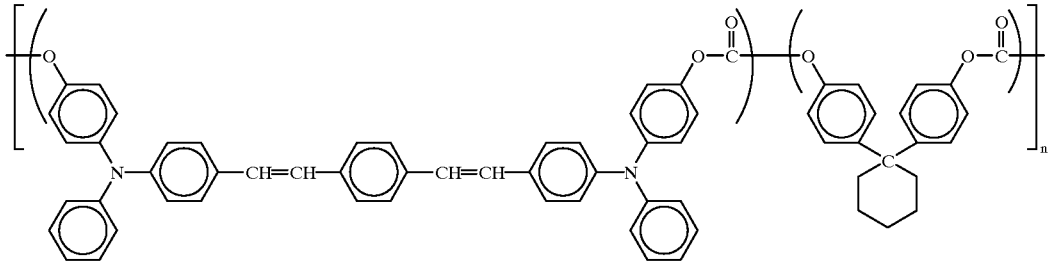

These charge transport polymer materials include homopolymers, random copolymers, alternating copolymers, and block copolymers. The molecular weight of these charge transport polymer materials is preferably from 10,000 to 500,000 when measured using gel permeation chromatography (GPC). The molecular weight (Mw) of these polymers is represented as a molecular weight (Mw) relative to polystyrene.

These charge transport materials have been disclosed in Japanese Laid-Open Patent Publications Nos. 8-269183, 9-71642, 9-104746, 9-272735, 11-29634, 9-235367, 9-87376, 9-110976, 9-268226, 9-221544, 9-227669, 9-157378, 9-302084, 9-302085, and 2000-26590.

Next, the filler for use in the second charge transport layer 372 will be explained.

Organic fillers and inorganic fillers can be used as the filler. Specific examples of the organic fillers include powders of fluorine-containing resins such as polytetrafluoroethylene; silicone resin powders, amorphous carbon powders, and the like compounds. Specific examples of the inorganic fillers include silica, tin oxide, zinc oxide, titanium oxide, alumina, zirconium oxide, indium oxide, antimony oxide, bismuth oxide, calcium oxide, tin oxide in which antimony is doped, indium oxide in which tin is doped, metal fluorides such as tin fluoride, calcium fluoride, and aluminum fluoride; potassium titanate, boron nitride, and the like compounds. Among these fillers, the inorganic fillers are preferably used to improve the abrasion resistance of the resultant photoreceptor because the inorganic fillers have a good hardness.

In addition, fillers having good electric insulation property are preferably used to produce images having good image qualities. Specific examples of such fillers include silica, titanium oxide, alumina, zinc oxide, and zirconium oxide. These fillers can be used alone or in combination. Further, it is possible to use a combination of one or more fillers having a permittivity not greater than 5 and one or more fillers having a permittivity not less than 5.

It is preferable to use fillers whose surfaces are treated with a surface treatment agent from the viewpoint of dispersibility of the fillers in the coating liquid and coated layer. When the dispersibility of the filler in the coated charge transport layer is poor, not only a residual potential increase, but also the transparency of the resultant layer deteriorates. In addition, coating defects tend to be generated, and the abrasion resistance of the resultant photoreceptor deteriorates. Therefore, a photoreceptor having good durability and capable of producing images having good image qualities cannot be prepared.

Known surface treatment agents can be used, however, surface treatment agents, which do not deteriorate the electric insulation property of a filler to be treated, are preferable. Specific examples of such surface treatment agents which can impart good dispersibility to a filler include titanate coupling agents, aluminum coupling agents, zircoaluminate coupling agents, higher fatty acids, and a combination of one or more of these agents with a silane coupling agent. In addition, $Al_2O_3$, $TiO_2$, $ZrO_2$, silicones, aluminum stearate and the like can also be used as the surface treatment agents. These agents can be used alone or in combination. When a filler is treated with a silane coupling agent, the resistance of the filler slightly decreases. However, by treating a filler with a combination of one of the above-mentioned surface treating agents with a silane coupling agent, there is a case in which the adverse effect can be prevented. The quantity of the surface treatment agent to be used, which depends on the average particle diameter of the filler to be treated, is preferably from 3 to 30% by weight, and more preferably from 5 to 20% by weight of the filler.

Suitable solvents for use in the charge transport layer coating liquid include ketones such as methyl ethyl ketone, acetone, methyl isobutyl ketone, and cyclohexanone; ethers such as dioxane, tetrahydrofuran, and ethyl cellosolve; aromatic hydrocarbons such as toluene, and xylene; halogenated hydrocarbons such as chlorobenzene, and dichloromethane; and esters such as ethyl acetates and butyl acetate.

Suitable dispersion devices useful for dispersing a filler in the charge transport layer coating liquid include known dispersion devices such as ball mills, sand mills, vibration mills and the like mills.

The concentration of the filler in the second charge transport layer 372 is preferably from 5 to 40% by weight of the solid components included in the layer 372, to maintain good abrasion resistance of the resultant photoreceptor, and to maintain good image qualities of images produced by the resultant photoreceptor (i.e., to prevent occurrence of background fouling and deterioration of image density caused by decrease of the photosensitivity of the resultant photoreceptor).

The average particle diameter of the filler dispersed in the charge transport layer 372 is preferably from 0.05 to 1.0 $\mu$m, and more preferably from 0.05 to 0.8 $\mu$m. When the particle diameter of the filler is too large, the filler is projected through the surface of the charge transport layer 372, and thereby a cleaning blade tends to be damaged, resulting in deterioration of cleaning effects.

Suitable coating methods useful for coating the charge transfer coating liquid include dipping methods, spray coating methods, ring coating methods, roll coating methods, gravure coating methods, nozzle coating methods, screen printing methods and the like coating methods. When a charge transport layer coating liquid dissolves a layer on which the coating liquid is coated, spray coating methods and ring coating methods are preferably used because the contact time during which the coating liquid contacts the layer is relatively short and the quantity of the solvent which is included in the coating liquid applied to the layer is relatively small.

The charge transport layer having two layers have been explained. However, the structure of the charge transport layer is not limited thereto. The charge transport layer having three or more layers can also be used. In these cases, it is needed that one or more of the above-mentioned charge transport polymer materials having a soft segment in their main chain and a triarylamine structure, and one or more of the fillers mentioned above are included in the uppermost layer.

The total thickness of these multi-layer type charge transport layer is preferably not greater than 30 $\mu$m to prepare a photoreceptor having high response and producing images having good resolution.

Next, the single-layer type charge transport layer 37 will be explained.

In this case, as mentioned above, it is necessary that at least the surface portion of the charge transport layer 37 includes a charge transport polymer material having a soft segment in its main chain and a triarylamine structure, and a filler. For example, a charge transport layer in which such a charge transport polymer material and a filler are included in the entire layer, and a layer in which the surface portion thereof includes such a charge transport polymer material and a filler at a high concentration (for example, a layer in which the concentration the polymer material and filler in a surface portion of the layer is greater than those in other portions positioned lower than the portion) may be used.

The former charge transport layer can be formed by coating a coating liquid, in which a filler is dispersed in a charge transport polymer material, on a charge generation layer. In this case, a low molecular charge transport material and/or a binder resin can be added thereto, if desired. Suitable low molecular charge transport materials and binder resins for use in such a charge transport layer include the above-mentioned low molecular charge transport materials and binder resins.

The latter charge transport layer can be formed by, for example, at first spray-coating a coating liquid which includes a charge transport polymer material and a filler at a low concentration, and successively spray-coating a coating liquid which includes them at a high concentration. In this case, the charge transport polymer materials and fillers mentioned above for use in the charge transport layers 371, 372 and 373 can also be used.

Next, single-layer type photosensitive layer 33 will be explained.

In the photosensitive layer 33, it is necessary that the layer includes a binder resin in which a charge generation material is dispersed. In addition, it is essential that the surface portion of the layer 33 includes a charge transport polymer material, which includes a soft segment in its main chain and a triarylamine structure, and a filler. Therefore, the photosensitive layer 33 can be formed by, for example, coating a coating liquid in which a charge generation material, a charge transport polymer material and a filler are dissolved or dispersed in a solvent, and drying the coated liquid.

In this case, a uniform photosensitive layer 33 in which a charge transport polymer material and a filler are uniformly included in the entire layer; and a photosensitive layer 33 in which a charge transport polymer material and a filler are included in the surface portion at a high concentration, can be used. In addition, a photosensitive layer 33 which is formed by coating a coating liquid which includes a charge generation material, and includes a charge transport polymer material and a filler at a relatively low concentration, and thereon coating a coating liquid which includes a charge generation material, and includes a charge transport polymer material and a filler at a relatively high concentration, can also be used.

The single-layer type photosensitive layer 33 may include a low molecular charge transport material and/or a binder resin other than with a charge generation material, a charge transport polymer material and a filler. Suitable binder resins for use in the photosensitive layer 33 include the resins mentioned above for use in the charge transport layer 37 and the charge generation layer 35. In addition, a charge deterioration preventing agent such as ring ether compounds, polyether compounds, and diphenoquinone derivatives may be added in the layer 33. The concentration of the charge deterioration preventing agent is preferably from 0.5 to 10 parts by weight per 100 parts by weight of the binder resin included in the layer 33.

The photosensitive layer 33 can be formed by coating a coating liquid, in which the above-mentioned materials are dissolved or dispersed in a solvent such as tetrahydrofuran, dioxane, dichloroethane, and cyclohexanone using a dispersion device, and then drying the coated liquid. Suitable coating methods include dipping methods, spray coating methods, bead coating methods, ring coating methods and the like coating methods. The thickness of the photosensitive layer 33 is preferably from 5 to 25 $\mu$m.

The photoreceptor of the present invention may include an undercoat layer between the electroconductive substrate and the photosensitive layer (between the electroconductive substrate and the charge generation layer when such multilayer type photosensitive layers as shown in FIGS. 2, 3 and 4 are used). The undercoat layer is formed, for example, to prevent moire in the resultant image, to decrease residual potential in the resultant photoreceptor, and to prevent charge injection from the substrate to the photosensitive layer, and coating quality of the upper layer (i.e., to form a uniform layer of the photosensitive layer 33 or the charge generation layer 35).

The undercoat layer mainly includes a resin. Since a photosensitive layer coating liquid, which typically includes an organic solvent, is coated on the undercoat layer, the resin used in the undercoat layer preferably has good resistance to popular organic solvents.

Specific examples of such resins for use in the undercoat layer include water-soluble resins such as polyvinyl alcohol, casein and polyacrylic acid; alcohol-soluble resins such as nylon copolymers, and methoxymethylated nylons; and crosslinkable resins such as polyurethane resins, melamine resins, alkyd-melamine resins, and epoxy resins. In addition, the undercoat layer may include a fine powder such as metal oxides (e.g., titanium oxide, silica, alumina, zirconium oxide, tin oxide, and indium oxide), metal sulfides, and metal nitrides.

A metal oxide layer which is formed, for example, by a sol-gel method using a silane coupling agent, titanium coupling agent or a chromium coupling agent can also be used as an undercoat layer.

In addition, a layer of aluminum oxide which is formed by an anodic oxidation method, and a layer of an organic compound such as polyparaxylylene or an inorganic compound such as SiO, $SnO_2$, $TiO_2$, ITO or $CeO_2$, which is formed by a vacuum evaporation method, are also preferably used as an undercoat layer.

The photosensitive layer and the charge transport layer may include a plasticizer and/or a leveling agent. Suitable plasticizers for use in the photoreceptor of the present invention include known plasticizers such as dibutyl phthalate, and dioctyl phthalate, which have been used as plasticizers for popular resins. The concentration of the plasticizers in the photosensitive layer is preferably from 0 to 30 parts by weight per 100 parts by weight of the binder resin included in the photosensitive layer.

In the photoreceptor of the present invention, one or more antioxidants can be used in one or more of the layers including an organic material. In particular, good results can be obtained when an antioxidant is included in the layer including a charge transport material.

Suitable antioxidants for use in the layers of the photoreceptor include the following compounds, but are not limited thereto.

Monophenol Compounds 2,6-di-t-butyl-p-cresol, butylated hydroxyanisole, 2,6-di-t-butyl-4-ethylphenol, stearyl-β-(3,5-di-t-butyl-4-hydroxyphenyl)propionate, and the like compounds;

Bisphenol Compounds 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), and the like compounds;

High Molecular Phenolic Compounds 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like compounds.

Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like compounds.

Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, and the like compounds.

Organic Sulfur-containing Compounds dilauryl-3,3'-thiodipropionate, distearyl-3,3'-thiodipropionate, ditetradecyl-3,3'-thiodipropionate, and the like compounds.

Organic Phosphorus-containing Compounds triphenylphosphine, tri(nonylphenyl)phosphine, tri(dinonylphenyl)phosphine, tricresylphosphine, tri(2,4-dibutylphenoxy)phosphine, and the like compounds.

These compounds are practically marketed as antioxidants for use in rubbers, plastics, and oils and fats.

The concentration of the antioxidant in the photosensitive layer is from 0.1 to 100 parts by weight, and preferably from 2 to 30 parts by weight, per 100 parts by weight of the charge transport material included in the photosensitive layer.

Hereinafter the image forming method and image forming apparatus using the photoreceptor of the present invention will be explained referring to drawings.

Figure 5:
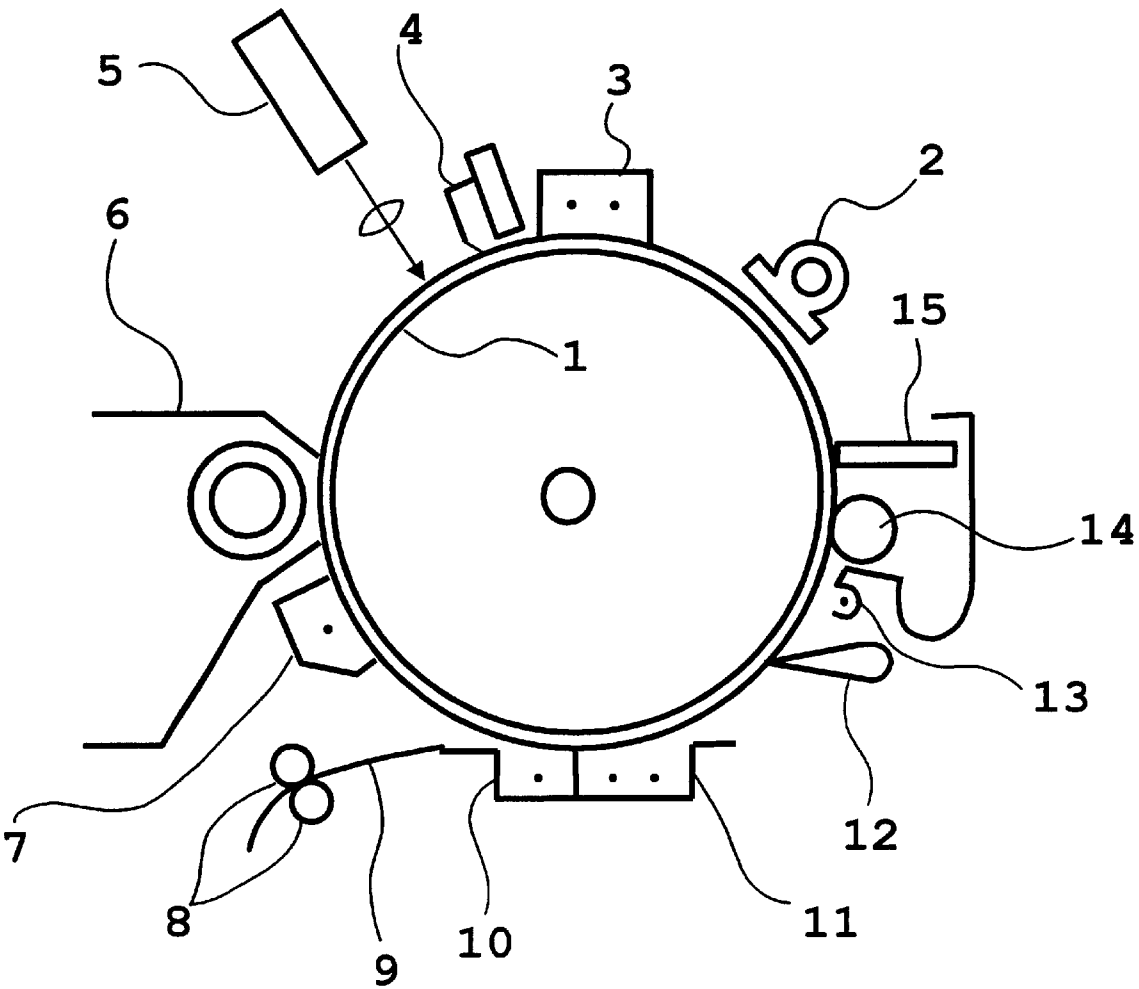
FIG. 5 is a schematic view illustrating the main part of an embodiment of the image forming apparatus of the present invention.

FIG. 5 is a schematic view illustrating a main part of an embodiment of the image forming apparatus of the present invention.

In FIG. 5, numeral 1 denotes a cylindrical photoreceptor. The photoreceptor 1 has a photosensitive layer (i.e., the single-layer type photosensitive layer, or the multi-layer type photosensitive layers) whose surface portion includes a charge transport polymer material, which includes a soft segment in its main chain and a triarylamine structure, and a filler. The photoreceptor has a cylindrical shape, however, a sheet photoreceptor and an endless-belt-shaped photoreceptor can also be used. Around the photoreceptor 1, a discharging lamp 2, a charger 3, an eraser 4, an imagewise light irradiating device 5, a developing unit 6, a pre-transfer charger 7, a transfer charger 10, a separation charger 11, a separation pick 12, a pre-cleaning charger 13, a cleaning brush 14, and a cleaning blade 15 are counterclockwise configured in this order. In addition, a pair of registration rollers 8 are provided to feed a transfer paper 9 to the space between the photoreceptor 1 and the transfer charger 10 (and the separation charger 11). The photoreceptor 1 rotates in a counterclockwise direction.

The photoreceptor 1 is positively or negatively charged with the charger 3 while the photoreceptor 1 is rotating. Residual toner is removed from the photoreceptor 1 by the eraser 4, and then the imagewise light irradiating device 5 irradiates the photoreceptor 1 with imagewise light to form an electrostatic latent image on the photoreceptor 1.

Suitable charging devices for use as the charger 3, pre-transfer charger 7, transfer charger 10, separation charger 11, and pre-cleaning charger 13 include known charging devices such as corotrons, scorotrons, solid state chargers, charging rollers and the like.

Any known charging devices can be used as the transfer charger 10; however, the transfer device as shown in FIG. 5, i.e., a combination of the transfer charger 10 with the separation charger 11, is preferable because of being efficient.

Suitable light sources for use in the imagewise light irradiating device 5 and the discharging lamp 2 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used. These light sources can also be used for the image transfer process, discharging process, and cleaning process, and a pre-exposure process which is optionally performed, if it is needed to irradiate the photoreceptor 1 with light in the processes.

The electrostatic latent image formed on the photoreceptor 1 is then developed with a toner on a developing roller 61 in the developing unit 6. The toner image formed on the photoreceptor 1 is then charged with the pre-transfer charger 7 so that the toner image has a charge suitable for transferring. The toner image is then transferred onto the transfer paper 9 while the transfer paper 9 is charged with the transfer charger 10. The transfer paper 9 is then charged with the separation charger 11 so as to easily separate from the photoreceptor 1 by being released from the state in which the transfer paper 9 and the photoreceptor 1 are electrostatically adhered to each other. The transfer paper 9 is then separated from the photoreceptor 1 with the separation pick 12. After the toner image transferring process, the surface of the photoreceptor 1 is cleaned using the pre-cleaning charger 13, the fur brush 14 and the cleaning blade 15. The residual toner remaining on the photoreceptor 1 can be removed only by a cleaning brush. Known brushes such as fur brushes and magnetic fur brushes can be used as the cleaning brush 14.

When the photoreceptor 1 which is previously charged positively (or negatively) is exposed to imagewise light, an electrostatic latent image having a positive (or negative charge) is formed on the photoreceptor 1. When the latent image having a positive (negative) charge is developed with a toner having a negative (positive) charge, a positive toner image (i.e., the same image as the latent image) can be obtained. In contrast, when the latent image having a positive (negative) charge is developed with a toner having a positive (negative) charge, a negative toner image (i.e., a reversal image) can be obtained. As the developing method, known developing methods can be used. In addition, as the discharging methods, known discharging methods can be used.

With respect to toners, only a black toner is used for producing black images, and a yellow, magenta and cyan toner are typically used for producing full color images. These toners typically include a fluidity imparting agent such as silica and titanium oxide to improve the fluidity of the toners.

Figure 6:
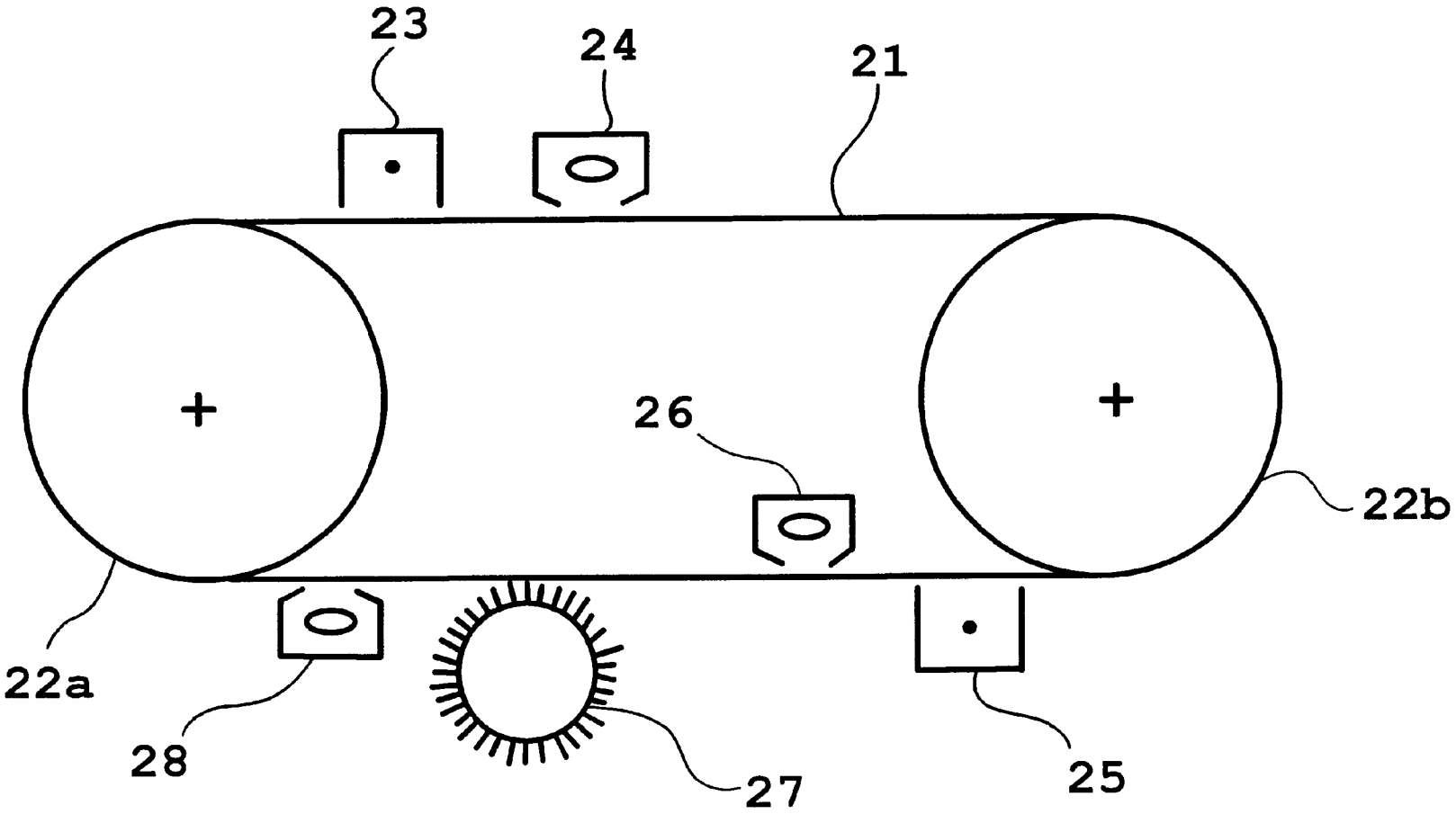
FIG. 6 is a schematic view illustrating the main part of another embodiment of the image forming apparatus of the present invention.

FIG. 6 is a schematic view illustrating a main part of another embodiment of the image forming apparatus of the present invention. In this embodiment, a belt-shaped photoreceptor 21 is used. The photoreceptor 21 has a photosensitive layer whose surface portion includes a charge transport polymer material, which includes a soft segment in its main chain and a triarylamine structure, and a filler. The belt-shaped photoreceptor 21 is supported and driven by drive rollers 22*a* and 22*b*. The photoreceptor 21 is charged with a charger 23, and then exposed to imagewise light emitted by an imagewise light irradiating device 24 to form an electrostatic latent image in the photoreceptor 21. The latent image is developed with a developing unit (not shown in FIG. 6) to form a toner image on the photoreceptor 21. The toner image is transferred onto a transfer paper (not shown) using a transfer charger 25. After the toner image transferring process, the surface of the photoreceptor 21 is cleaned with a cleaning brush 27 after performing a pre-cleaning light irradiating operation using a pre-cleaning light irradiating device 26. Then the photoreceptor 21 is discharged by being exposed to light emitted by a discharging light source 28. In the pre-cleaning light irradiating process, light may irradiate the photoreceptor 21 from the side of the substrate thereof. In this case, the substrate has to be light-transmissive.

In addition, it is possible to prepare a unit, which includes a belt-shaped photoreceptor, and drive/support rollers and which can be attached to or detached from an image forming apparatus.

Figure 7:
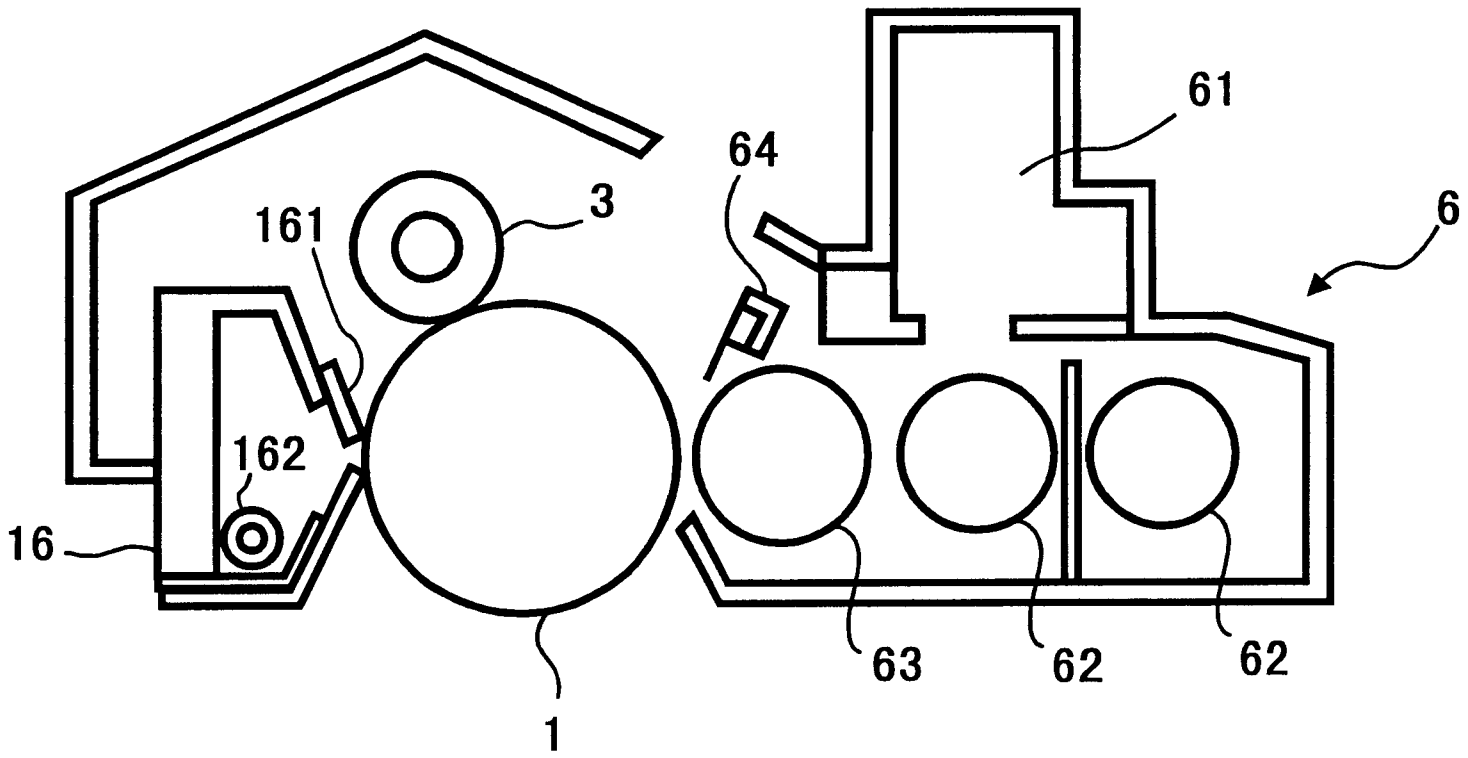
FIG. 7 is a schematic view illustrating an embodiment of the process cartridge of the present invention.

FIG. 7 is a schematic view illustrating an embodiment of the process cartridge of the present invention.

In the process cartridge as shown in FIG. 7, a photoreceptor 1, a charging roller 3', a developing unit 6 which supplies a proper amount of a developer to the surface of the photoreceptor 1, and a cleaning unit 16 which includes a blade 161 cleaning the surface of the photoreceptor 1 after toner images are transferred from the photoreceptor to a receiving material, are incorporated as a unit. In the developing unit 6, a developer setting case 61 in which a developer can be contained, a screw 62 for feeding the developer, a developing sleeve 63 on which the developer (or toner) is held, and a doctor 64 which forms a developer (or toner) layer on the developing sleeve 63 are configured. In the cleaning unit 16, a toner feeding coil 162 is provided to feed collected toner particles to reuse the toner particles.

The process cartridge of the present invention includes the photoreceptor of the present invention and at least one of a charging device, a developing device, and a cleaning device.

This cartridge can be attached to and detached from an image forming apparatus which includes devices needed for forming images, such as an imagewise light irradiating device, a transfer device, a discharging device, a fixing device, a receiving material feeding device, etc.

The photoreceptor 1 includes an electroconductive substrate and a photosensitive layer which is formed on the substrate and whose surface portion includes a charge transport polymer material having a soft segment in its main chain, and a filler.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Photosensitive Layer 1

The following components were contained in a ball mill pot which had a diameter of 15 cm and which included zirconia media having a diameter of 10 mm, and then milled for 48 hours.

| | |
|---|---|
| Charge generation material having the following formula | 22 |
| Cyclohexanone | 400 |

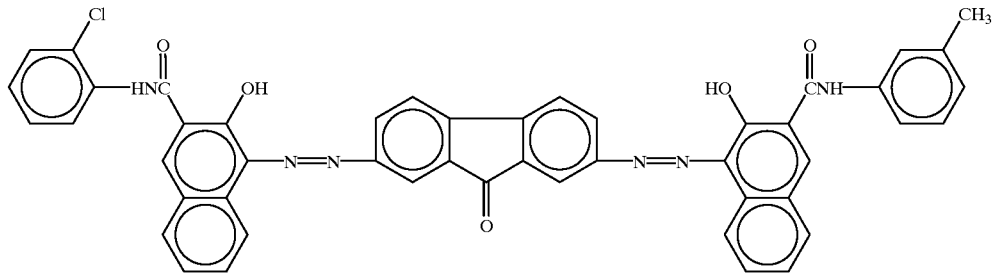

Then 500 parts of cyclohexanone were added to the mixture. Thus, a dispersion 1 was prepared.

The following components were mixed.

| | |
|---|---|
| Tetrahydrofuran | 660 |
| Binder resin having formula I-1 (Tradenamed as C1400 and manufactured by Teijin Chemicals Ltd., a Japanese company) | 100 |
| Low molecular charge transport material having formula II-2 | 70 |
| Polyethylene glycol (Tradenamed as Ionet MC1400 and manufactured by Sanyo Chemical Industries Ltd., a Japanese company) | 3 |
| Silicone oil (Tradenamed as KF50 and manufactured by Shin-Etsu Chemical Co., Ltd., a Japanese company) | 0.01 |

Two hundred (200) parts of the mixture were mixed with 100 parts of the dispersion 1 prepared above to prepare a coating liquid for a photosensitive layer 1.

Preparation of Photosensitive Layer 2

The following components were mixed.

| | |
|---|---|
| Titanium oxide (Tradenamed as CR97 and manufactured by Ishihara Sangyo Kaisha Ltd., a Japanese company) | 1.5 |
| Dispersion 1 prepared above | 20 |
| 5% solution of charge transport polymer material having formula III-9 (Weight average molecular weight (Mw) thereof is 126,000, and the solvent is a mixture of 100 parts of cyclohexanone and 100 parts of tetrahydrofuran) | 80 |
| Low molecular charge transport material having formula II-2 | 1 |

The mixture was dispersed for 2 hours using a vibration mill including zirconia media to prepare a dispersion 2. The dispersion 2 was diluted with 100 parts of tetrahydrofuran. Thus, a coating liquid for a photosensitive layer 2 was prepared.

Preparation of Photoreceptor

The following undercoat layer coating liquid was coated on an aluminum cylinder having an outside diameter of 30 mm at a coating speed of 5 mm/sec using a dip coating method.

Formulation of Undercoat Layer Coating Liquid

| | |
|---|---|
| Polyamide resin (Tradenamed as CM8000 and manufactured by Toray Ltd., a Japanese company) | 10 |
| Methanol | 220 |
| n-butanol | 100 |

The coated undercoat coating liquid was dried for 10 minutes at 100° C. Thus, an undercoat layer having a thickness of 0.3 μm was prepared. Then the photosensitive layer coating liquid 1 was coated thereon using a dip coating method, and dried for 30 minutes at 130° C. Thus, a photosensitive layer 1 having a thickness of 20 μm was formed. Then the photosensitive layer coating liquid 2 was coated on the photosensitive layer 1 using a spray coating method, and dried for 30 minutes at 130° C. Thus, a photosensitive layer 2 having a thickness of 5 μm was formed. Thus, an electrophotographic photoreceptor of the present invention was prepared.

Comparative Example 1

The procedure for preparation of the photoreceptor in Example 1 was repeated except that the photosensitive layer 2 was not formed.

Thus, a comparative photoreceptor was prepared.

Example 2

The procedure for preparation of the photoreceptor in Example 1 was repeated except that the coating liquid for the photosensitive layer 2 was changed as follows:

| | |
|---|---|
| Charge transport polymer material having formula III-11 (copolymerization ratio of 1:1 by weight, polystyrene-conversion weight average molecular weight of 135,000) | 3 |
| Dispersion 1 prepared above | 12.5 |
| Silica (Tradenamed as KMPX100 and manufactured by Shin-Etsu Chemical Co., Ltd.) | 1 |
| Dichloromethane | 150 |

The coating liquid for the photosensitive layer 2 was coated using a ring coating method.

Comparative Example 2

The procedure for preparation of the photoreceptor in Example 2 was repeated except that the coating liquid for the photosensitive layer 2 was changed as follows:

| | |
|---|---|
| Charge transport polymer material having formula III-11 (copolymerization ratio of 1:1 by weight, polystyrene-conversion weight average molecular weight of 135,000) | 3 |
| Dispersion 1 prepared above | 12. 5 |
| Dichloromethane | 150 |

In this case, the photosensitive layer 2 did not include a filler.

Comparative Example 3

The procedure for preparation of the photoreceptor in Example 1 was repeated except that the charge transport polymer material III-9 in the coating liquid for the photosensitive layer 2 was changed to a compound having the following formula:

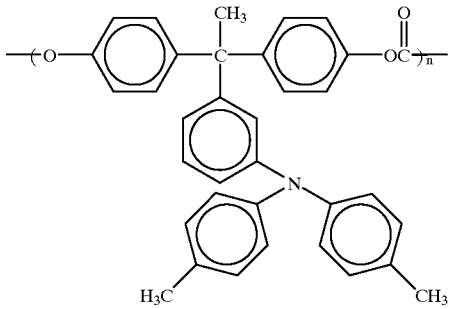

Each of the thus prepared photoreceptors of Examples 1 and 2 and Comparative Examples 1 to 3 was set in the process cartridge as shown in FIG. 7. The cartridge was set in a copier Imagio MF200 manufactured by Ricoh to perform a running test in which 10,000 copies were repeatedly produced.

The image forming conditions were as follows:

(1) Polarity of charge formed on the photoreceptor: positive charge;

(2) Developer: two component developer including a cyan toner having the following formulation and an average particle diameter of 7 μm, and a carrier:

| | |
|---|---|
| Polyester resin | 93.45% |
| Copper phthalocyanine | 5% |
| Silica | 0.7% |
| Titanium oxide | 0.85% |

The charge of the toner was positive.

(3) Light source of imagewise light irradiating device: laser light having a wavelength of 655 nm; and (4)

Initial potential (VD) of photoreceptor: 800 V (dark area)

Initial potential (VL) of photoreceptor: 100 V (lighted area)

In addition, the abrasion of the photoreceptor after the running test was determined as follows:

$$\text{Abrasion}=T1-T2$$

wherein T1 represents the thickness of the initial photosensitive layer and T2 represents the thickness of the photosensitive layer after the running test. The thickness was measured by a thicknessmeter, FISHERSCOPE MMS, manufactured by Fisher Instruments, which measures thickness utilizing eddy current.

The results are shown in Table 1.

TABLE 1

| | Initial sensitivity* (μJ/cm²) | Abrasion (μm) | ⊿ VD*2 (V) | ⊿ VL*3 (V) | Image qualities after running test |
|---|---|---|---|---|---|
| Ex. 1 | 0.38 | 0.23 | −20 | 40 | White streaks and cyanic |

TABLE 1-continued

| | Initial sensitivity* ($\mu$J/cm$^2$) | Abrasion ($\mu$m) | ⊿ VD*2 (V) | ⊿ VL*3 (V) | Image qualities after running test |
|---|---|---|---|---|---|
| | | | | | streaks were not observed |
| Ex. 2 | 0.52 | 0.20 | −20 | 50 | White streaks and cyanic streaks were not observed |
| Comp. Ex. 1 | 0.31 | 1.02 | −50 | 100 | Many white streaks and cyanic streaks were observed |
| Comp. Ex. 2 | 0.49 | 0.50 | −40 | 60 | White streaks and cyanic streaks were observed |
| Comp. Ex. 3 | 0.40 | 0.50 | −40 | 50 | Cyanic streaks were observed from the 1,000th image because cracks was formed in the photoreceptor |

Initial sensitivity*: quantity of light needed for decaying the potential of photoreceptor from 800 V to 100 V.
⊿ VD*2: Difference between the initial VD and the VD after the running test
⊿ VL*3: Difference between the initial VL and the VL after the running test As can be understood from Table 1, the photoreceptors of Examples 1 and 2 have a narrow range of variation in VD and VL, and a small abrasion quantity. In addition, the photoreceptors can produce good images without white and cyanic streaks even after the running test.

On the contrary, the comparative photoreceptors of Comparative Examples 1 and 2, which do not include a filler in the uppermost portion thereof have a relatively wide range of variation in VD and VL, and relatively large abrasion quantity. In addition, white and cyanic streaks are observed in the image produced after the running test. Further, as can be understood from the evaluation results of the photoreceptor of Comparative Example 3, cracks tend to be formed in the photoreceptor because the charge transport polymer material used for the photoreceptor does not include a soft segment therein.

Example 3

The following undercoat layer coating liquid, a charge generation layer coating liquid, and a coating liquid for charge transport layer 1 were coated/dried one by one in this order on an aluminum cylinder having a diameter of 30 mm. Thus, an undercoat layer having a thickness of 3.5 $\mu$m, a charge generation layer having a thickness of 0.2 $\mu$m, and a charge transport layer 1 having a thickness of 20 $\mu$m were formed on the aluminum cylinder. In addition, a coating liquid for charge transport layer 2 was coated thereon by a spray coating method and then dried to form a charge transport layer 2 having a thickness of 3 $\mu$m.

Preparation of Undercoat Layer

The following components were mixed for 24 hours using a ball mill to prepare the undercoat layer coating liquid.

| | |
|---|---|
| Alkyd resin (Tradenamed as Bekkozol 1307-60-EL and manufactured by Dainippon Ink and Chemicals Inc., a Japenese company) | 6 |
| Melamine resin (Tradenamed as Super Bekkamin G-821-60 and manufactured by Dainippon Ink and Chemicals Inc., a Japenese company) | 4 |
| Titanium oxide (Tradenamed as CREL and manufactured by Ishihara Sangyo Kaisha Lts.) | 40 |
| Methyl ethyl ketone | 200 |

Preparation of Charge Generation Layer

The following components were mixed for 24 hours using a ball mill to prepare the charge generation layer coating liquid.

| | |
|---|---|
| Oxotitanium phthalocyanine pigment | 2 |
| Polyvinyl butyral (Tradenamed as XYHL and manufactured by Union Carbide Corp.) | 0.2 |
| Tetrahydrofuran | 50 |

Preparation of Charge Transport Layer 1

The following components were mixed to prepare a solution.

| | |
|---|---|
| Polystyrene (Tradenamed as HRM and manufactured by Denki Kagaku Kogyo K. K., a Japanese company) | 12 |
| Low molecular charge transport material having formula II-2 | 12 |
| Dichloromethane | 90 |
| 1% silicone oil solution of dichloromethane (silicone oil: Tradenamed as KF50 and manufactured by Shin-Etsu Silicone Co, Ltd., a Japanese company) | 1 |

Preparation of Charge Transport Layer 2

The following components were mixed for 2 hours using a vibration mill including zirconia beads to prepare the coating liquid for the charge transport layer 2.

| | |
|---|---|
| Charge transport polymer material having formula III-12 | 5 |
| Alumina (Tradenamed as Sumicorundum AA03 and manufactured by Sumitomo Chemical Co., Ltd., a Japanese company) | 1.5 |
| Cyclohexanone | 100 |
| Tetrahydrofuran | 100 |

Example 4

The procedure of preparation of the photoreceptor in Example 3 was repeated except that the coating liquids for the charge transport layers 1 and 2 were replaced with the following coating liquids, respectively:

Formulation of Coating Liquid for Charge Transport Layer 1

| | |
|---|---|
| Acrylic resin (Tradenamed as BR88 and manufactured by Mitsubishi Rayon Co., Ltd.) | 15 |
| Low molecular charge transport material having the following formula | 15 |

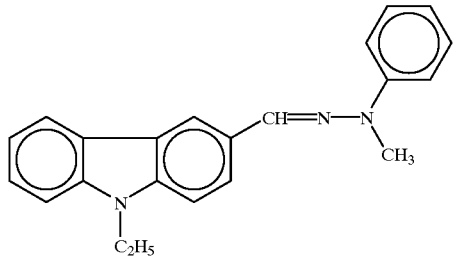

| | |
|---|---|
| Dichloromethane | 120 |
| 1% silicone oil solution of dichloromethane (silicon oil: Tradenamed as KF50 and manufactured by Shin-Etsu Silicone Co., Ltd.) | 1 |

Formulation of Coating Liquid for Charge Transport Layer 2

| | |
|---|---|
| Charge transport polymer material having formula III-14 (Weight average molecular weight (Mw) of 180,000) | 5 |
| Titanium oxide (Tradenamed as CR97 and manufactured by Ishihara Sangyo Kaisha Ltd.) | 1.5 |
| Cyclohexanone | 100 |
| Tetrahydrofuran | 100 |

Comparative Example 4

The procedure for preparation of the photoreceptor in Example 3 was repeated except that the thickness of the charge transport layer 1 was changed to 23 μm and the charge transport layer 2 was not formed.

Comparative Example 5

The procedure for preparation of the photoreceptor in Example 4 was repeated except that the thickness of the charge transport layer 1 was changed to 23 μm and the charge transport layer 2 was not formed.

Comparative Example 6

The procedure for preparation of the photoreceptor in Example 3 was repeated except that the charge transport layer 2 was replaced with a surface layer having the following formulation:

Formulation of Surface Layer

| | |
|---|---|
| Polycarbonate resin having formula I-3 | 4 |
| Cyclohexanone | 48 |
| Tetrahydrofuran | 48 |

The thickness of the surface layer was 3 μm.

Thus, a surface layer which did not include a filler and a charge transport material was formed as an uppermost layer.

Each of the thus prepared photoreceptors of Examples 3 and 4 and Comparative Examples 4 to 6 was set in the process cartridge as shown in FIG. 7. The cartridge was set in a copier Imagio MF200 manufactured by Ricoh to perform a running test in which 50,000 copies were repeatedly produced.

The image forming conditions were as follows:

(1) Polarity of charge formed on photoreceptor: negative charge;

(2) Developer: two component developer including a cyan toner having the following formulation and an average particle diameter of 7 μm, and a carrier:

| | |
|---|---|
| Polyester resin | 93.45% |
| Copper phthalocyanine | 5% |
| Silica | 0.7% |
| Titanium oxide | 0.85% |

The charge of the toner was negative.

(3) Light source of imagewise light irradiating device: laser light having a wavelength of 780 nm; and (4)

Initial potential (VD) of photoreceptor: −800 V (dark area)

Initial potential (VL) of photoreceptor: −100 V (lighted area)

The variation in VD and VL and abrasion were evaluated in the same way as mentioned above except that the number of the produced copy images was changed from 10,000 to 50,000.

The results are shown in Table 2.

TABLE 2

| | Initial sensitivity* (μJ/cm²) | Abrasion (μm) | ⊿ VD*² (V) | ⊿ VL*³ (V) | Image qualities after running test |
|---|---|---|---|---|---|
| Ex. 3 | 0.15 | 0.34 | −10 | 10 | Good image without background fouling |
| Ex. 4 | 0.15 | 0.20 | −20 | 50 | Good image without background fouling |
| Comp. Ex. 4 | 0.12 | 10 (after 5,000 copies) | — | — | Running test was stopped due to large abrasion when 5,000 copies were produced |
| Comp. Ex. 5 | 0.18 | 4 (after 10,000 copies) | — | — | Running test was stopped due to large abrasion when 10,000 copies were produced |
| Comp. Ex. 6 | — | — | — | — | Running test was not performed because initial VL was not decreased to −100 V |

Initial sensitivity*: quantity of light needed for decaying the potential of the photoreceptor from −800 V to −100 V.

⊿ VD*²: Difference between the initial VD and the VD after the 50,000-copy running test ⊿ VL*³: Difference between the initial VL and the VL after the 50,000-copy running test The mark "—" means that the item was not measured.

As can be understood from Table 2, the photoreceptors in Examples 3 and 4 has small abrasion quantity even after the 50,000-copy running test. In addition, the range of variation in VD and VL is small, and therefore, the images have good image qualities even after the 50,000-copy running test.

On the contrary, the comparative photoreceptors in Comparative Examples 4 and 5, which do not have a charge transport layer including a filler, have large abrasion quantity. Therefore, the photoreceptors cannot produce images having good image qualities. In addition, as can be understood from the evaluation results of the photoreceptor of Comparative Example 6 which has a surface layer including no charge transport material, the residual potential of the photoreceptor cannot be decreased to −100 V, and therefore, the photoreceptor cannot be tested in the copier.

Example 5

The procedure for preparation of the photoreceptor in Example 3 was repeated except that the coating liquids of charge transport layers 1 and 2 were replaced with the following coating liquids of charge transport layers 1 and 2, respectively:

Formulation of Coating Liquid of Charge Transport Layer 1

| | |
|---|---|
| Binder resin having formula I-1 (Tradenamed as K1300 and manufactured by Teijin Ltd., a Japanese company) | 15 |
| Low molecular charge transport material having formula II-2 | 15 |
| Dichloromethane | 120 |
| 1% silicone oil solution of dichloromethane (silicone oil: KF50 manufactured by Shin-Etsu Silicone Co., Ltd.) | 5 |

(silicone oil: KF50 manufactured by Shin-Etsu Silicone Co., Ltd.)

Formulation of Coating Liquid for Charge Transport Layer 2

| | |
|---|---|
| Charge transport polymer material having formula III-24 (Weight average molecular weight Mw of 190,000) | 5 |
| Alumina (Tradenamed as Sumicorundum AA03 and manufactured by Sumitomo Chemical Co., Ltd., a Japanese company) | 1.5 |
| Cyclohexanone | 100 |
| Tetrahydrofuran | 100 |

Examples 6 to 11

The procedure for preparation of the photoreceptor in Example 5 was repeated except that the materials (i.e., the charge transport polymer material, filler and solvents) of the charge transport layer 2 were replaced with the materials as shown in Table 3.

TABLE 3

| | Charge transport polymer material | Filler | Solvent | Volume average particle diameter of the filler (μm) |
|---|---|---|---|---|
| Ex. 6 | III-4 | $TiO_2$ (TTO-55C, manufactured by Ishihara Sangyo Kaisha) | Cyclohexanone/ THF = 1/1 | 0.42 |
| Ex. 7 | III-3 | $TiO_2$ (TTO-55S, manufactured by Ishihara Sangyo Kaisha) | Cyclohexanone/ THF = 1/1 | 0.38 |
| Ex. 8 | III-10 | Alumina (AA03 manufactured by Sumitomo Chemical) | Cyclohexanone/ THF = 1/1 | 0.60 |
| Ex. 9 | III-14 | $TiO_2$ (CR50, manufactured by Ishihara Sangyo Kaisha) | Cyclohexanone/ THF = 1/1 | 0.42 |
| Ex. 10 | III-16 | Silica (KMPX100, manufactured by Shin-Etsu Chemical) | Cyclohexanone/ THF = 1/1 | 0.30 |
| Ex. 11 | III-22 | $SiO_2$ (H2000, manufactured by Hoechst) | Cyclohexanone/ THF = 1/1 | 0.15 |

Volume average particle diameter was measured by an instrument, CAPA, manufactured by HORIBA LTD.

Comparative Example 7

The procedure for preparation of the photoreceptor in Example 5 was repeated except that the charge transport layer 2 was not formed.

Thus, a comparative photoreceptor was prepared.

Comparative Example 8

The procedure for preparation of the photoreceptor in Example 8 was repeated except that the charge transport polymer material having formula III-10 included in charge transport layer 2 was replaced with a compound having the following formula:

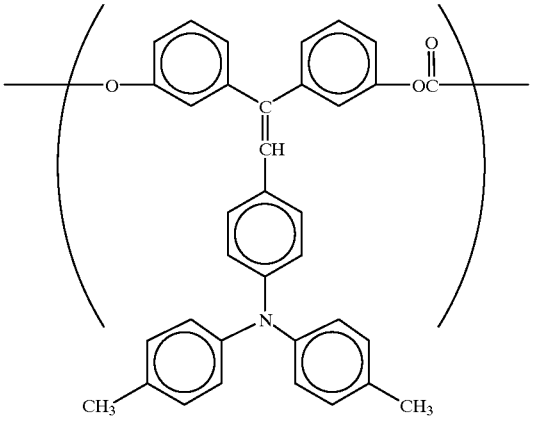

The weight average molecular weight (Mw) of the compound relative to polystyrene was 200,000.

Thus, a comparative photoreceptor was prepared.

Comparative Example 9

The procedure for preparation of the photoreceptor in Example 11 was repeated except that the charge transport polymer material having formula III-22 included in charge transport layer 2 was replaced with a compound having the following formula:

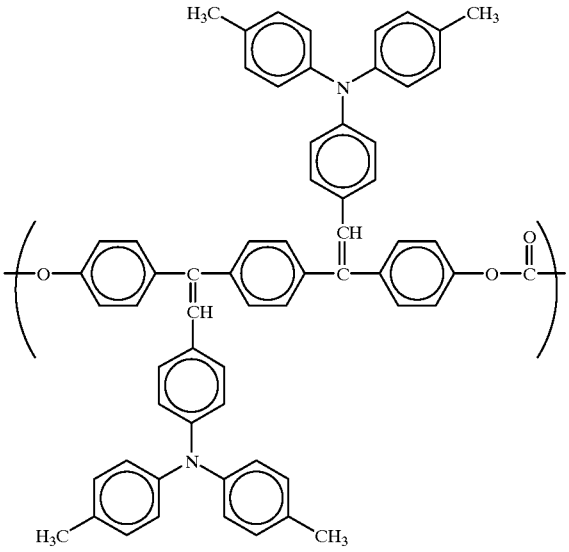

The weight average molecular weight (Mw) of the compound relative to polystyrene was 220,000.

Thus, a comparative photoreceptor was prepared.

Each of the photoreceptors of Examples 5 to 11 and comparative photoreceptors of Comparative Examples 7 to 9 was evaluated by the same method as performed for the photoreceptor of Example 3. The results are shown in Table 4.

TABLE 4

| | Initial sensitivity ($\mu J/cm^2$) | Abrasion ($\mu m$) | ⊿VD (V) | ⊿VL (V) | Image qualities after running test |
|---|---|---|---|---|---|
| Ex. 5 | 0.12 | 0.40 | −30 | −10 | Good image without background fouling |
| Ex. 6 | 0.12 | 0.45 | −40 | −10 | Good image without background fouling |
| Ex. 7 | 0.13 | 0.25 | −20 | −10 | Good image without background fouling |
| Ex. 8 | 0.12 | 0.48 | −20 | −10 | Good image without background fouling |
| Ex. 9 | 0.13 | 0.43 | −30 | −10 | Good image without background fouling |
| Ex. 10 | 0.12 | 0.30 | −20 | −10 | Good image without background fouling |
| Ex. 11 | 0.12 | 0.50 | −30 | −10 | Good image without background fouling |
| Comp. Ex. 7 | 0.11 | 5.0 | −70 | 20 | Background fouling was observed |
| Comp. Ex. 8 | 0.12 | 0.8 | −50 | −10 | Cyanic spots were observed from 20,000th image |
| Comp. Ex. 9 | 0.12 | 0.9 | −50 | −10 | Cyanic spots were observed from 20,000th image |

As can be understood from Table 4, the photoreceptors of Examples 5 to 11 have small abrasion quantity, and can stably produce images having good images. On the contrary, the comparative photoreceptor of Comparative Example 7, which does not include a charge transport layer including a filler, has large abrasion quantity, and in addition produces images having background fouling. Further, the comparative photoreceptors of Comparative Examples 8 and 9, which do not include a charge transport polymer material having a soft segment, produce images having cyanic spots, and therefore the photoreceptors have a short life.

Example 12

The procedure for preparation of the photoreceptor in Example 5 was repeated except that the coating liquid for the charge transport layer 2 was replaced with a coating liquid having the following formulation:

Formulation of Coating Liquid for Charge Transport Layer 2

| | |
|---|---|
| Charge transport polymer material having formula III-12 (weight average molecular weight (Mw) | 0.8 |

-continued

| | |
|---|---|
| relative to polystyrene is 150,000) | |
| Alumina (Tradenamed as AA03 and manufactured by Sumitomo Chemical Co., Ltd., a Japanese company) | 0.3 |
| Dichloromethane | 30 |

Examples 13 to 25

The procedure of preparation for the photoreceptor in Example 12 was repeated except that the materials (i.e., the charge transport polymer material, and filler) of the charge transport layer 2 were replaced with the materials as shown in Table 5.

TABLE 5

| | Charge transport polymer material | Filler | Volume average particle diameter ($\mu$m) |
|---|---|---|---|
| Ex. 13 | III-28 | $TiO_2$ (CR50, manufactured by Ishihara) | 0.35 |
| Ex. 14 | III-19 | Alumina (AA03, manufactured by Sumitomo) | 0.65 |
| Ex. 15 | III-13 | $TiO_2$ (TAF1510S, manufactured by Fuji Titanium) | 0.28 |
| Ex. 16 | III-14 | $TiO_2$ (TAF1510T, manufactured by Fuji Titanium) | 0.25 |
| Ex. 17 | III-15 | $TiO_2$ (KMPX100, manufactured by Shin-Etsu) | 0.30 |
| Ex. 18 | III-16 | $TiO_2$ (TA400SJ, manufactured by Fuji Titanium) | 0.32 |
| Ex. 19 | III-25 | $TiO_2$ (MT500B, manufactured by Tayca Corp.) | 0.26 |
| Ex. 20 | III-24 | $TiO_2$ (Nanotek manufactured by Shiiai) | 0.24 |
| Ex. 21 | III-27 | $SiO_2$ (NSFX-01, manufactured by Shin-Etsu) | 0.38 |
| Ex. 22 | III-29 | $SiO_2$ (NSFX-05, manufactured by Shin-Etsu) | 0.22 |
| Ex. 23 | III-26 | $TiO_2$ (ST41, manufactured by Ishihara) | 0.41 |
| Ex. 24 | III-27 | $SiO_2$ (H2000, manufactured by Hoechst AG) | 0.28 |
| Ex. 25 | III-23 | $SiO_2$ (H2000, manufactured by Hoechst AG) | 0.29 |

Ishihara: Ishihara Sangyo Kaisha Ltd.
Sumitomo: Sumitomo Chemical Co., Ltd.
Fuji Titanium: Fuji Titanium Industry Co., Ltd., a Japanese company
Shin-Etsu: Shin-Etsu Chemical Co., Ltd.
Tayca Corp.: Tayca Corp., a Japanese company
Shiiai: Shiiai Chemical Co., Ltd., a Japanese company

Comparative Example 10

The procedure for preparation of the photoreceptor in Example 12 was repeated except that the alumina was removed from the coating liquid of the charge transport layer 2.

Thus, a photoreceptor having a charge transport layer 2 which did not include a filler was prepared.

Comparative Example 11

The procedure for preparation of the photoreceptor in Example 12 was repeated except that the coating liquid for the charge transport layer 2 was replaced with a coating liquid which was prepared as follows:

Preparation of Coating Liquid for Charge Transport Layer 2

The following components were mixed and dispersed for 2 hours using a vibration mill to prepare a coating liquid for the charge transport layer 2.

| | |
|---|---|
| Polymethylphenylsilane (weight average molecular weight (Mw) relative to polystyrene is 160,000) | 0.8 |
| Alumina (Tradenamed as AA03 and manufactured by Sumitomo Chemical Co., Ltd.) | 0.3 |
| Tetrahydrofuran | 20 |

Comparative Example 12

The procedure for preparation of the photoreceptor in Example 12 was repeated except that the coating liquid for the charge transport layer 2 was replaced with a coating liquid which was prepared as follows:

Preparation of Coating Liquid for Charge Transport Layer 2

The following components were mixed and dispersed for 2 hours using a vibration mill to prepare a coating liquid for the charge transport layer 2.

Polymer having the following formula 0.8

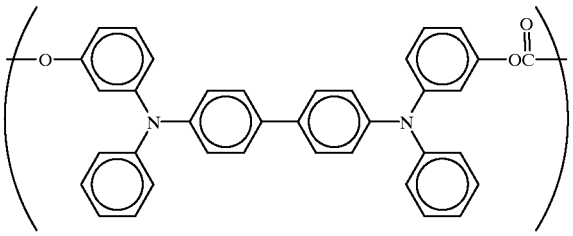

(weight average molecular weight relative to polystyrene (Mw) is 240,000)

| | |
|---|---|
| Alumina (Tradenamed as AA03, manufactured by Sumitomo Chemical Co., Ltd.) | 0.3 |
| Tetrahydrofuran | 20 |

Each of the photoreceptors of Examples 12 to 25 and comparative photoreceptors of Comparative Examples 10 to 12 was evaluated in the same way as performed in Example 3. The results are shown in Table 6.

TABLE 6

| | Initial sensitivity ($\mu$J/cm$^2$) | Abrasion ($\mu$m) | ⊿VD (V) | ⊿VL (V) | Image qualities after running test |
|---|---|---|---|---|---|
| Ex. 12 | 0.12 | 0.20 | −20 | −10 | Good image without background fouling |
| Ex. 13 | 0.13 | 0.30 | −40 | −10 | Good image without background fouling |

TABLE 6-continued

| | Initial sensitivity ($\mu J/cm^2$) | Abrasion ($\mu m$) | ⊿VD (V) | ⊿VL (V) | Image qualities after running test |
|---|---|---|---|---|---|
| Ex. 14 | 0.12 | 0.35 | −20 | −10 | Good image without background fouling |
| Ex. 15 | 0.13 | 0.28 | −20 | −20 | Good image without background fouling |
| Ex. 16 | 0.12 | 0.45 | −30 | −20 | Good image without background fouling |
| Ex. 17 | 0.13 | 0.38 | −20 | −20 | Good image without background fouling |
| Ex. 18 | 0.12 | 0.32 | −20 | −10 | Good image without background fouling |
| Ex. 19 | 0.12 | 0.38 | −30 | −10 | Good image without background fouling |
| Ex. 20 | 0.13 | 0.21 | −20 | −10 | Good image without background fouling |
| Ex. 21 | 0.13 | 0.40 | −20 | 0 | Good image without background fouling |
| Ex. 22 | 0.14 | 0.30 | −10 | 10 | Good image without background fouling |
| Ex. 23 | 0.15 | 0.32 | −10 | 10 | Good image without background fouling |
| Ex. 24 | 0.12 | 0.35 | −10 | 20 | Good image without background fouling |
| Ex. 25 | 0.12 | 0.28 | −10 | 10 | Good image without background fouling |
| Comp. Ex. 10 | 0.12 | 2.0 | −30 | 20 | Cyanic spots were observed |
| Comp. Ex. 11 | 0.16 | — | — | — | * |
| Comp. Ex. 12 | 0.14 | — | — | — | ** |

*Running test was stopped at the 10,000th image because the photo-sensitive layer was partially peeled.
**Running test was stopped at 20,000th image because Cyanic streaks were observed in the 20,000th image due to cracks in the photo-sensitive layer.

As can be understood from Table 6, the photoreceptors of Examples 12 to 25 have small abrasion quantity, and can stably produce images having good images, even after the 50,000-copy running test. On the contrary, the comparative photoreceptor of Comparative Example 10, which does not include a filler, has large abrasion quantity. In addition, the comparative photoreceptor of Comparative Example 11, which includes polymethylsilane as a charge transport polymer material, has a problem in that a part of the charge transport layer is peeled. Further, the comparative photoreceptor of Comparative Example 12, in which the charge transport layer 2 includes only a charge transport polymer material having no soft segment, has a problem in that cracks are formed in the photosensitive layer, resulting in formation of undesired image of cyanic streaks.

Example 26

The procedure for preparation of the photoreceptor in Example 3 was repeated except that the coating liquids for the charge transport layers 1 and 2 were replaced with coating liquids for charge transport layers 1 and 2, respectively:

Formulation of Coating Liquid for Charge Transport Layer 1

| | |
|---|---|
| Charge transport polymer material having formula III-33 (weight average molecular weight (Mw) of 120,000) | 5 |
| Dichloromethane | 30 |
| 1% silicone oil solution of dichloromethane | 0.1 |

Formulation of Coating Liquid for Charge Transport Layer 2

| | |
|---|---|
| Charge transport polymer material having formula III-33 (weight average molecular weight (Mw) of 120,000) | 0.8 |
| Silica (Tradenamed as KMPX100 and manufactured by Shin-Etsu Chemical Co., Ltd.) | 0.2 |
| Dichloromethane | 30 |

Examples 27 and 28

The procedure for preparation of the photoreceptor in Example 3 was repeated except that the materials (the charge transport polymer materials, and filler) included in the charge transport layer coating liquids 1 and 2 were replaced with the corresponding materials described in Table 7, respectively.

TABLE 7

| | Charge transport polymer material in CTL 1 | Charge transport polymer material in CTL 2 | Filler in CTL 2 | Volume average particle diameter ($\mu m$) |
|---|---|---|---|---|
| Ex. 27 | III-30 | III-34 | $TiO_2$, manufactured by Nanotech CI | 0.28 |
| Ex. 28 | III-31 | III-5 | Silica (KMFX100, manufactured by Shin-Etsu Chemical) | 0.32 |

CTL: Charge transport layer

Comparative Example 13

The procedure for preparation of the undercoat layer and charge generation layer in Example 3 was repeated. A charge transport layer 1 was formed thereon in the same way as performed in Example 26. In addition, the following coating liquid was coated thereon and dried to form a charge transport layer 2 of 3 $\mu m$ thick.

Formulation of Coating Liquid for Charge transport layer 2

| | |
|---|---|
| Charge transport polymer material having formula III-12 | 0.8 |
| Dichloromethane | 30 |

Example 29

The procedure for preparation of the photoreceptor in Example 25 was repeated except that the coating liquid for the charge transport layer 2 was replaced with a coating liquid having the following formulation:

Formulation of Coating Liquid for Charge Transport Layer 2

| | |
|---|---|
| Charge transport polymer material having formula III-33 (weight average molecular weight (Mw) of 120,000) | 0.5 |
| Silica (Tradenamed as KMPX100 and manufactured by Shin-Etsu Chemical Co., Ltd.) | 0.5 |
| Dichloromethane | 30 |

Example 30

The procedure for preparation of the photoreceptor in Example 25 was repeated except that the coating liquid for the charge transport layer 2 was replaced with a coating liquid having the following formulation:

Formulation of Coating Liquid for Charge Transport Layer 2

| | |
|---|---|
| Charge transport polymer material having formula III-33 (weight average molecular weight of 120,000) | 0.95 |
| Silica (Tradenamed as KMPX100 and manufactured by Shin-Etsu Chemical Co., Ltd.) | 0.05 |
| Dichloromethane | 30 |

Each of the photoreceptors of Examples 26 to 30 and comparative photoreceptor of Comparative Example 13 was evaluated in the same way as performed in Example 3. The results are shown in Table 8.

TABLE 8

| | Initial sensitivity ($\mu$J/cm$^2$) | Abrasion ($\mu$m) | ⊿ VD (V) | ⊿ VL (V) | Image qualities after running test |
|---|---|---|---|---|---|
| Ex. 26 | 0.15 | 0.23 | −10 | 20 | Good image without background fouling |
| Ex. 27 | 0.16 | 0.22 | −20 | 30 | Good image without background fouling |
| Ex. 28 | 0.17 | 0.21 | −10 | 30 | Good image without background fouling |
| Comp. Ex. 13 | 0.14 | 2.0 | −50 | 20 | Cyanic spots were observed |
| Ex. 29 | 0.23 | — | — | — | * |
| Ex. 30 | 0.12 | 1.5 | −50 | 20 | Cyanic spots were observed |

*The running test was not performed because VL was high and therefore the photosensitivity was poor, which was caused by the uneven surface of the photoreceptor.

The photoreceptors of Examples 26 to 28, which include a charge transport layer 2 whose surface includes a filler, has a small abrasion quantity, and can stably produce images having good image qualities. The comparative photoreceptor of Comparative Example 13, which has a charge transport layer 2 including no filler, had large abrasion quantity, and produced images having cyanic spots. The photoreceptor of Example 29, in which a filler is included to much, has a poor photosensitivity, and a poor cleaning property due to uneven surface thereof. In addition, when the concentration of a filler is not greater than 5%, the abrasion of the resultant photosensitive layer is relatively large.

Example 31

The procedure for preparation of the photoreceptor in Example 8 was repeated except that the aluminum cylinder substrate was replaced with a nickel belt substrate which was prepared by electroforming and which had a thickness of 30 $\mu$m, a circumference of 180 mm, and a width of 340 mm.

Thus, an endless belt photoreceptor was prepared.

Example 32

The procedure for preparation of the photoreceptor in Example 11 was repeated except that the aluminum cylinder substrate was replaced with a nickel belt substrate which was prepared by electroforming and which had a thickness of 30 $\mu$m, a circumference of 180 mm, and a width of 340 mm.

Thus, an endless belt photoreceptor was prepared.

Comparative Example 14

The procedure for preparation of the photoreceptor in Comparative Example 8 was repeated except that the aluminum cylinder substrate was replaced with a nickel belt substrate which was prepared by electroforming and which had a thickness of 30 $\mu$m, a circumference of 180 mm, and a width of 340 mm.

Thus, a comparative endless belt photoreceptor was prepared.

Comparative Example 15

The procedure for preparation of the photoreceptor in Comparative Example 9 was repeated except that the aluminum cylinder substrate was replaced with a nickel belt substrate which was prepared by electroforming and which had a thickness of 30 $\mu$m, a circumference of 180 mm, and a width of 340 mm.

Thus, an comparative endless belt photoreceptor was prepared.

Each of the endless belt photoreceptors of Examples 31 and 32 and comparative endless belt photoreceptors of Comparative Examples 14 and 15 was set in the image forming apparatus as shown in FIG. 6 to evaluate the photoreceptors.

The endless belt photoreceptor was supported and driven by two drive rollers having a diameter of 20 mm. The endless belt photoreceptor and the two rollers were integrated to form a unit (i.e., a photoreceptor magazine), which can be attached to or detached from the image forming apparatus.

The image forming conditions were as follows:

(1) Light source of imagewise light irradiating device: laser light having a wavelength of 635 nm (2)
Initial surface potential (VD) of photoreceptor: −800 V (dark area)
Initial surface potential (VL) of photoreceptor: −100 V (lighted area)

(3) Developer: the two-component developer mentioned above for use in Example 3

(4) Developing method: reverse developing method

The photoreceptor was evaluated with respect to the following items:

(A) A running test in which 50,000 copies were continuously produced under an environmental condition of 22 to 25° C. in temperature and 40 to 60% in relative humidity.

(B) A preservation test in which the photoreceptor magazine was preserved for 1 month under a condition of room temperature and normal humidity, and then the photoreceptor was evaluated whether cracks were observed in the photosensitive layer and with respect to image qualities.

(C) Another preservation test in which the same preservation test was performed except that the preservation condition was changed to 30° C. and 85% RH and the preservation period was 2 weeks.

The results are shown in Table 9.

TABLE 9

| | Image quality | Preservation test | | | |
|---|---|---|---|---|---|
| | | 22–25° C. 40–60% RH | | 30° C. 85 % RH | |
| | after running test | Cracks | Image quality | Cracks | Image quality |
| Ex. 31 | Good image without background fouling and deterioration of resolution | None | Good images without undesired images | None | Good images without undesired images |
| Ex. 32 | Good image without background fouling and deterioration of resolution | None | Good images without undesired images | None | Good images without undesired images |
| Comp. Ex. 14 | Cyanic spots were observed | Cracks* | Cyanic streaks and white streaks*5 | Cracks*3 | Cyanic streaks and white streaks*5 |
| Comp. Ex. 15 | Cyanic spots were observed | Cracks*2 | Cyanic streaks and white streaks*5 | Cracks*4 | Cyanic streaks and white streaks*5 |

Cracks*: Many cracks of about 1 to 2 mm are formed in the photosensitive layer which is preserved while positioned on the drive roller
Cracks*2: Many cracks of from 1 to 2 mm are formed in the photosensitive layer which is preserved while positioned on the drive roller
Cracks*3: Many cracks of a few mm to 4 cm are formed in the photosensitive layer which is preserved while positioned on the drive roller
Cracks*4: Many cracks of a few mm to 5 cm are formed in the photosensitive layer which is preserved while positioned on the drive roller
*5Cyanic streaks are observed in background area and white streaks are observed in cyanic solid images, which are caused by the cracks in the photoreceptor.

As can be understood from Table 9, the endless belt photoreceptors of the present invention do not cause cracks, and can produce good images even after the 50,000-copy running test and the preservation test. On the contrary, the comparative endless belt photoreceptors (Comparative Examples 14 and 15), in which a charge transport polymer material having no soft segment is used, produce images having cyanic spots. In addition, the photoreceptors tend to cause cracks after the preservation test, i.e., the photoreceptor has poor durability.

This document claims priority and contains subject matter related to Japanese Patent Application No. 11-233969, filed on Aug. 20, 1999, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor comprising an electroconductive substrate and a photosensitive layer which is formed overlying the substrate, wherein said photosensitive layer comprises a charge generation material, a charge transport polymer material comprising triarylamine structure and having a soft segment in a main chain thereof, and a filler.

2. The photoreceptor according to claim 1, wherein the charge transport polymer material comprises charge transport polycarbonate.

3. The photoreceptor according to claim 1, wherein a concentration of the filler in an uppermost portion of the photosensitive layer is greater than the concentration of filler in any other portion of the photosensitive layer.

4. The photoreceptor according to claim 1, wherein the photosensitive layer further comprises a charge generation layer comprising the charge generation material, and a charge transport layer comprising the charge transport polymer material and the filler.

5. The photoreceptor according to claim 4, wherein the filler is present in the charge transport layer in an amount of from about 5 to about 40% by weight.

6. The photoreceptor according to claim 4, wherein the charge transport layer comprises a first charge transport layer comprising at least one second charge transport polymer material in addition to the charge transport polymer material, and a second charge transport layer comprising the charge transport polymer material and the filler.

7. The photoreceptor according to claim 4, wherein the charge transport layer further comprises a first charge transport layer comprising a low molecular charge transport material and a binder resin, and a second charge transport layer comprising the charge transport polymer material and the filler.

8. The photoreceptor according to claim 7, wherein the filler is present in the second charge transport layer in an amount of from about 5 to about 40% by weight.

9. The photoreceptor according to claim 7, wherein the low molecular charge transport material comprises a charge transport material having the following formula (1):

(1)

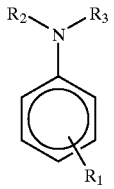

wherein R1 represents a hydrogen atom, a substituted or unsubstituted alkyl group, a halogen atom, a substituted or unsubstituted aryl group; and R2 and R3 independently represent a substituted or unsubstituted aryl group.

10. The photoreceptor according to claim 7, wherein the binder resin comprises a resin having a formula selected from the group consisting of the following formulae (2) and (3):

wherein R4, R5, R6 and R7 independently represent a hydrogen atom, a substituted or unsubstituted alkyl group, a halogen atom or a substituted or unsubstituted aryl group; X represents a divalent aliphatic group, or a divalent alicyclic group; t is 0 or 1; and Y represents a linear, branched or ring alkylene group having from 1 to 12 carbon atoms, —O—, —S—, —SO—, —$SO_2$—, —CO—, or —CO—O—Z—O—CO— in which Z represents a divalent aliphatic group, or a group having the following formula:

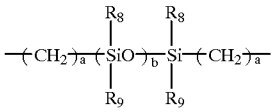

wherein a is an integer of from 1 to 20, and b is an integer of from 1 to 2000; and R8 and R9 independently represent a substituted or unsubstituted alkyl group, or a substituted or unsubstituted aryl group, wherein R6 and R7 may be the same to or different from each other, and R8 and R9 may be the same to or different from each other; p is a number of from 0.1 to 1, q is a number of from 0 to 0.9, and n is an integer of from 5 to 5000.

11. The photoreceptor according to claim 1, wherein the charge transport polymer material comprises a charge transport polymer material having a formula selected from the group consisting of the following formulae (4) to (13):

(2)

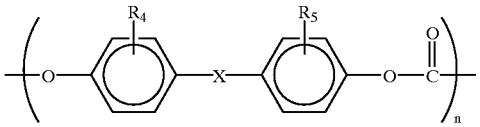

(3)

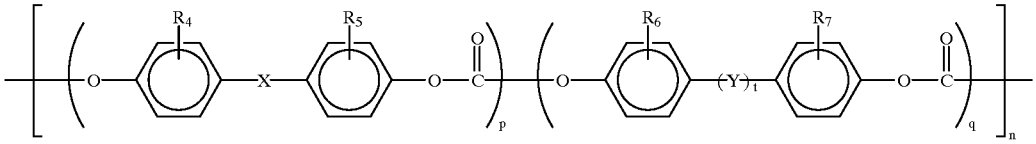

(4)
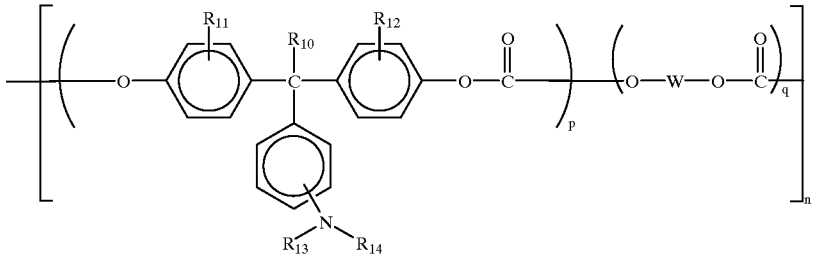
(5)
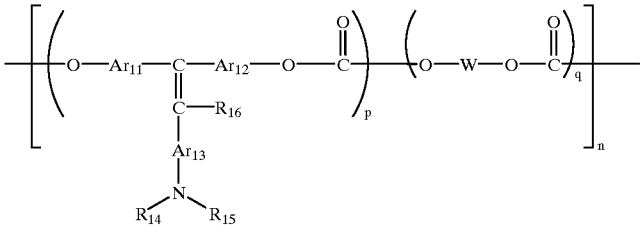
(6)
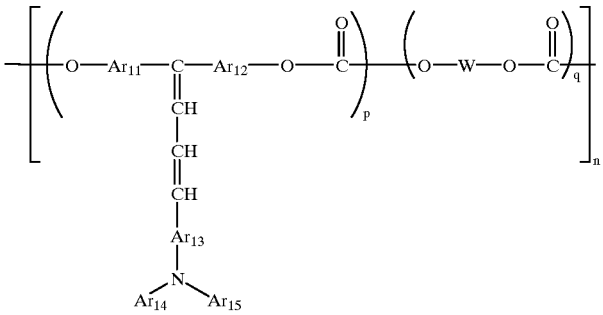
(7)
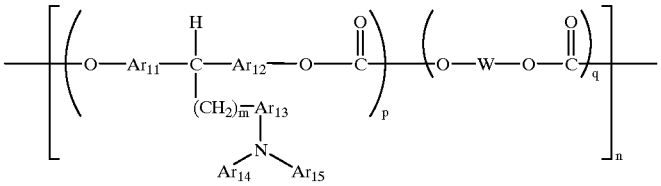
(8)
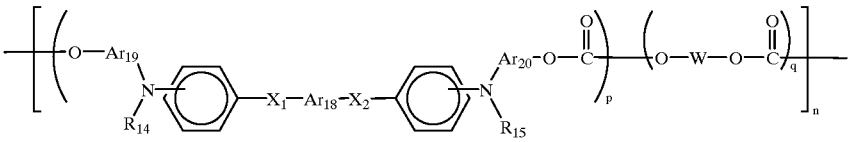
(9)
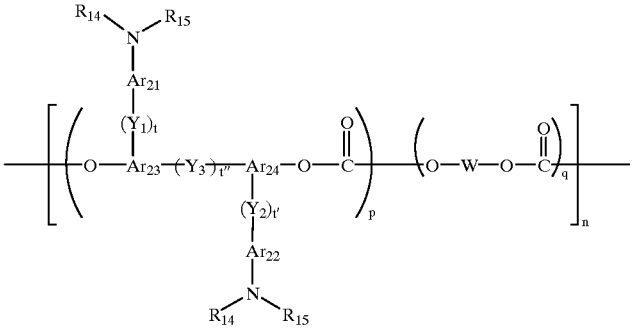

-continued (10)

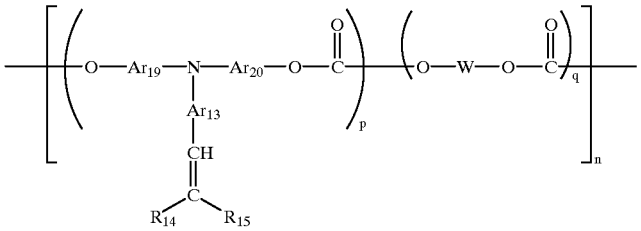

(11)

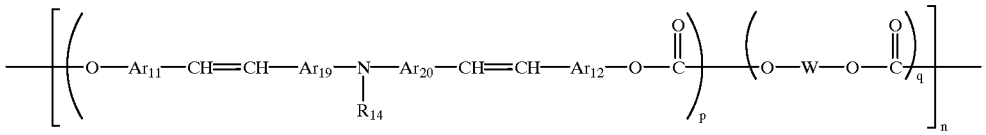

(12)

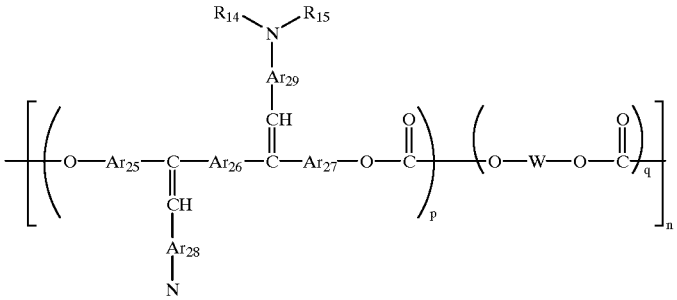

(13)

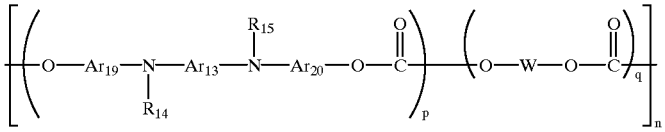

wherein R11, R12 and R13 independently represent a hydrogen atom, a substituted or unsubstituted alkyl group, or a halogen atom; R10 represents a hydrogen atom, or a substituted or unsubstituted alkyl group; R14, R15, Ar14 and Ar15 independently represent a substituted or unsubstituted aryl group; R16 represents a hydrogen atom, a substituted or unsubstituted alkyl group, or a substituted or unsubstituted aryl group; Ar11, Ar12, Ar13, Ar18, Ar19, Ar20, Ar21, Ar22, Ar23, Ar24, Ar25, Ar26, Ar27, Ar28 and Ar29 independently represent an arylene group; p is a number not less than 0.1 and less than 1 and q is a number greater than 0 and not greater than 0.9; n represents a number of repeating units and is an integer of from 5 to 5000; m is an integer of from 1 to 5; X1, X2, Y1, Y2 and Y3 independently represent a substituted or unsubstituted alkylene group, a substituted or unsubstituted cycloalkylene group, a substituted or unsubstituted alkyleneether group, an oxygen atom, a sulfur atom or a vinylene group; t, t' and t" is independently 0 or 1; and W represents a divalent aliphatic group, a divalent alicyclic group or a divalent group having the following formula (14):

(14)

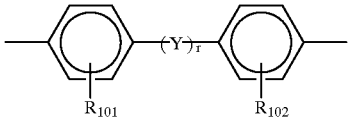

wherein R101 and R102 independently represent a substituted or unsubstituted alkyl group, a substituted or unsubstituted aryl group or a halogen atom; r is 0 or 1; and Y represents a linear, branched or cyclic alkylene group having from 1 to 12 carbon atoms, or —O—, —S—, —SO—, —$SO_2$—, —CO—, or —CO—O—Z—O—CO—, wherein Z represents a divalent aliphatic group.

12. The photoreceptor according to claim 1, wherein the filler is present in the photosensitive layer in an amount of from about 5 to 40% by weight.

13. The photoreceptor according to claim 1, wherein the filler comprises an inorganic filler.

14. The photoreceptor according to claim 13, wherein the inorganic filler comprises a filler selected from the group consisting of titanium oxide, silica and alumina.

15. The photoreceptor according to claim 13, wherein the photoreceptor is belt-shaped.

16. An image forming apparatus comprising:

a photoreceptor;

a charging device which charges the photoreceptor;

an imagewise light irradiating device which irradiates the charged photoreceptor with imagewise light to form an electrostatic latent image on the photoreceptor;

a developing device which develops the electrostatic latent image with a toner to form a toner image on the photoreceptor; and a transfer device which transfers the toner image onto a receiving material, wherein the photoreceptor comprises an electroconductive substrate and a photosensitive layer which is formed overlying the substrate, and wherein the photosensitive layer comprises a charge generation material, a charge transport polymer material comprising triarylamine structure and having a soft segment in a main chain thereof, and a filler.

17. A process cartridge comprising;

a photoreceptor; and at least one of a charging device which charges the photoreceptor, a developing device which develops an electrostatic latent image formed on the photoreceptor, and a cleaning device which cleans a surface of the photoreceptor, wherein the process cartridge is capable of being attached to and detached from an image forming apparatus, wherein the photoreceptor comprises an electroconductive substrate, and a photosensitive layer which is formed overlying the substrate, and wherein the photosensitive layer comprises a charge generation material, a charge transport polymer material comprising triarylamine structure and having a soft segment in a main chain thereof, and a filler.

18. An image forming method comprising:

providing a photoreceptor comprising an electroconductive substrate, and a photosensitive layer which is formed overlying the substrate, wherein the photosensitive layer comprises a charge generation material, a charge transport polymer material comprising triarylamine structure and a soft segment in a main chain thereof, and a filler;

charging the photoreceptor;

irradiating the charged photoreceptor with imagewise light to form an electrostatic latent image thereon;

developing the latent image with a toner to form a toner image on the photoreceptor; and transferring the toner image to a receiving material.

* * * * *